US007024148B2

(12) United States Patent
Uehara et al.

(10) Patent No.: US 7,024,148 B2
(45) Date of Patent: Apr. 4, 2006

(54) FIXING DEVICE, FIXING METHOD AND IMAGE FORMING APPARATUS

(75) Inventors: Yasuhiro Uehara, Nakai-machi (JP); Motofumi Baba, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 190 days.

(21) Appl. No.: 10/667,490

(22) Filed: Sep. 23, 2003

(65) Prior Publication Data

US 2004/0067082 A1 Apr. 8, 2004

(30) Foreign Application Priority Data

Sep. 24, 2002 (JP) ..... 2002-276851
Sep. 4, 2003 (JP) ..... 2003-313142

(51) Int. Cl.
*G03G 15/20* (2006.01)

(52) U.S. Cl. ..... 399/341

(58) Field of Classification Search ..... 399/328, 399/333, 339, 341, 92; 219/216
See application file for complete search history.

(56) References Cited

U.S. PATENT DOCUMENTS 4,223,203 A * 9/1980 Elter ..... 219/216
4,639,405 A * 1/1987 Franke ..... 430/124
5,085,962 A * 2/1992 Aslam et al. ..... 430/99
5,235,393 A * 8/1993 Merle ..... 399/341
5,436,709 A * 7/1995 Sakaizawa et al. ..... 399/69
5,521,688 A * 5/1996 Moser ..... 399/321
6,272,310 B1 * 8/2001 Blair et al. ..... 399/341
6,526,250 B1 * 2/2003 Usui et al. ..... 399/307
6,687,483 B1 * 2/2004 Chen et al. ..... 399/341
6,721,532 B1 * 4/2004 Kosugi et al. ..... 399/341

FOREIGN PATENT DOCUMENTS

| | | |
|---|---|---|
| JP | A 61-122666 | 6/1986 |
| JP | A 63-006584 | 1/1988 |
| JP | A 63-192068 | 8/1988 |
| JP | A 01-265283 | 10/1989 |
| JP | A 01-279277 | 11/1989 |
| JP | A 02-162383 | 6/1990 |

* cited by examiner

*Primary Examiner*—Robert Beatty
(74) *Attorney, Agent, or Firm*—Oliff & Berridge, PLC

(57) ABSTRACT

Provided is a fixing device and a fixing method, and an image forming apparatus using the fixing device, in which at least heat is applied to an unfixed toner image formed on a recording material to soften or melt toner of the unfixed toner image into a state of being able to be deformed by an external force, and while maintained in the state of being able to be deformed by the external force, the toner is pressed in a nonheating manner to be flowed. Accordingly, device structure can be simplified to be free of wasteful energy consumption, an image of image quality excellent in transparency of a toner image and in OHP permeability as well as of high glossiness which is free from gloss nonuniformity can be obtained while preventing curling of a recording material.

22 Claims, 8 Drawing Sheets

FIXING DEVICE, FIXING METHOD AND IMAGE FORMING APPARATUS

FIELD OF THE INVENTION AND RELATED ART STATEMENT

The present invention relates in general to a fixing device and a fixing method with which an unfixed toner image is fixed when forming an image using an apparatus for forming an image with toner such as a copying machine, a laser beam printer, a facsimile, a microfilm reader printer, or a recording machine, and to an image forming apparatus using the fixing device.

More specifically, the invention relates to a fixing device and a fixing method of forming an unfixed toner image of an image pattern corresponding to objective image information on a surface of a recording material (such as an electrofacsimile sheet, an electrostatic recording sheet, a transferring material sheet or a printing paper) in accordance with a direct system or an indirect (transferring) system using toner made of a resin or the like having a heat melting property by an image forming process method such as an electrophotography, electrostatic recording, or magnetic recording to heating-fixing process the unfixed toner image in the form of a permanent fixed image on a surface of the recording material carrying thereon the unfixed toner image to form a surface glossy image, and an image forming apparatus using the fixing device.

The present invention, especially, is suitable for forming a color surface glossy image with color toner.

In order to obtain a toner image with toner made of a resin or the like having heat melting property by the image formation process method such as electrophotography, electrostatic recording, or magnetic recording, in the usual way, an unfixed toner image of an image pattern is heated and pressed to be fixed.

In recent years, in particular, for a full-color image, a demand for an enhancement of image quality by making the image glossy has been increased.

FIG. 7 shows a schematic constructional view of a fixing device of a general two-roller system. In FIG. 7, reference numeral 102 designates a heating roll having a heat source 104 arranged therein, and reference numeral 106 designates a pressure roll which press-contacts the heating roll 102 to form a nip portion N. The heating roll 102 is rotated in a direction indicated by an arrow X, and the pressure roll 106 is rotated in a direction indicated by an arrow Y to follow the heating roll 102. A surface of the heating roll 102 is heated by the heat of the heat source 104 to be held at a temperature equal to or higher than a temperature at which the toner as will be described below is softened.

A recording material 108 a surface of which has an unfixed toner image 110 formed by carrying toner in the shape of an image pattern is inserted into the nip portion N formed between the heating roll 102 and the pressure roll 106. Then, the toner of the unfixed toner image 110 becomes a softening state by the heat applied from the surface of the heating roll 102 and the pressure due to an abutting pressure between the heating roll 102 and the pressure roll 106 (hereinafter this state may be referred to as "melted toner" in some cases). Thereafter, the toner is cooled to be fixed on the surface of the recording material 108 to thereby form a toner image 112 as a permanent fixed image.

However, it is known that in the toner image 112 obtained from such a general fixing device, the glossiness of the image is insufficient.

On the other hand, as methods for, when fixing a toner image on a transferring paper sheet, suitably making the toner image glossy to provide high image quality, a large number of techniques were disclosed. Hereinafter, four examples of (1) to (4) will be given.

(1) A method of carrying out fixing twice or more:

A technique is proposed for continuously carrying out heating and fixing twice or more to make a toner image glossy (refer to JP 63-192068 A, for example).

(2) A method of forming two kinds of nips in a fixing device:

A technique is proposed for selectively passing a transferring paper sheet through a conveyance path of a fixing device having two kinds of nips formed therein to make a toner image glossy (refer to JP 1-265283 A, for example).

(3) A method in which the fixing is carried out for a transferring paper sheet having a processing sheet laminated thereon, and Thereafter, the processing sheet is Peeled Off:

A technique is proposed, in which a transferring paper sheet having a processing sheet with a smooth surface laminated thereon is heated and pressed, and after cooling, the processing sheet is peeled off to thereby make a toner image glossy (refer to JP 61-122666 A, for example).

(4) A method of laminating a transparent film on a toner image:

A technique is proposed, in which a transparent film or the like is laminated on a toner image on a surface of a recording material to thereby add a glossy surface to the toner image (refer to JP 1-279277 A and JP 63-006584 A, for example).

(5) A method in which belt fixing is adopted, and cooling and peeling-off are carried out:

A technique is proposed, in which a fixing film (fixing belt) is made to tightly contact a surface carrying thereon a toner image, a multi-color toner image on a surface of a recording material is heated and softened to be melted to provide color mixture, through the fixing film, by a heating body arranged on the side opposite to the tightly contacting side of the fixing film of the recording material, and subsequently, the resultant heated toner image showing color mixture is cooled and solidified with the fixing film being made to tightly contact the recording material, and then the fixing film is separated from the recording material to thereby add a glossy surface to the toner image (refer to JP 02-162383 A, for example).

However, the techniques described in the above literatures have various problems.

"A method of carrying out fixing twice or more" of (1) and "a method of forming two kinds of nips in a fixing device" of (2) are effective for smoothing a toner image surface to make it glossy. However, since plural fixing devices each including a heater are installed, the arrangement of the devices becomes complex, the heating energy is increased, and also since separation is carried out at a high temperature after the fixing, irregularities are generated on the image surface to cause an irregular reflection, and hence transparency of the toner is poor. These points are problems.

In "a method in which the fixing is carried out for a transferring paper sheet having a processing sheet laminated thereon, and thereafter, the processing sheet is peeled off" of (3), the toner image on the surface of the recording material needs to be fixed once. Hence, there is a problem in that the apparatus becomes complicated, and since the recording material is heated and pressed twice, curl tends to be caused.

In "a method of laminating a transparent film on a toner image" of (4), a thickness is increased only by the lamination of the transparent film. Hence, there is a problem in that essential properties of the recording material, e.g., a thickness, flexibility and the like are lost, and revision can not be made for the image formation surface, and further, when an OHP (overhead projector) film is used as the recording material, the whole transmittance is reduced (an OHP permeability is reduced).

In "a method in which belt fixing is adopted, and the cooling and peeling-off are carried out" of (5), there is a problem in that nonuniformity tends to occur in a degree of glossiness of the fixed output image. That is to say, in this method, the cooling process before the peeling-off makes the fixed image glossy. Hence, the nonuniformity in glossiness occurs in the fixed image due to nonuniformity of a tight contact force between the fixing film (fixing belt) and the recording material carrying thereon the toner image in the cooling process. In the case where a state of the tight contact between the fixing film and the recording material is partially changed in the cooling process, a paper sheet may rise from the fixing film in partial places of the toner image in some cases. As this causes, expansion and contraction of the recording material, and blowing of air from the inside of the recording material due to the heat are conceivable. The image glossiness in places where the paper sheet rises from the fixing film due to such causes becomes lower than that in places where the toner image is cooled with the tight contact in the periphery being sufficient, and becomes nonuniformity of the image glossiness.

Also, if for the purpose of enhancing the cooling effect for obtaining high glossiness, there is adopted such a construction that a period of time required for the cooling process is lengthened, and a distance from the heating color mixture process is increased, then an increased scale of the apparatus will be incurred. In addition, since the fixing film cooled once needs to be heated up to a predetermined temperature again in a next cycle, the power consumption is large, and a period of time required for the heating is lengthened.

SUMMARY OF THE INVENTION

In the light of the foregoing, the present invention provides a fixing device, a fixing method and an image forming apparatus which are capable of, from the start, stably obtaining an image which has image quality excellent in transparency of a toner image and OHP permeability with a simple apparatus construction, and which has high glossiness and is free from gloss nonuniformity, without consuming useless energy and with which curl is hardly caused in a recording material.

In addition, the present invention provides a fixing device, a fixing method and an image forming apparatus which are capable of controlling glossiness of a fixed image up to desired glossiness.

The present inventors, first of all, discussed general fixing device in order to solve the above-mentioned problems. As a result, the present inventors found out a mechanism for reducing glossiness, and finally got to devise the present invention. This process will now be described with reference to FIG. 7.

First of all, it was found out that in a general fixing device as shown in FIG. 7, in the vicinity of an outlet of the nip portion N, a toner image 112 is sufficiently heated and melted to tightly contact a surface of a smooth heating roll 102, and hence a surface of the toner image 112 has high glossiness substantially equal to that of the surface of the heating roll 102.

However, the melted toner adhered to a surface of a recording material 108 peeled off from the surface of the heating roll 102 becomes a free state after the heating and fixing. Waving is caused on the surface of the toner image 112 which has been smooth until that time to generate fine undulation due to an increase in adhesive strength between the surface of the toner image 112 and the heating roll 102 acting on the surface of the toner image 112 during the peeling-off, and in cohesive force accompanying reduction in temperature of the melted toner itself. Thereafter, the toner image is naturally cooled to be solidified with the undulation of the surface of the toner image 112 being held. In such a surface state, the glossiness for a color image tends to get an insufficient level.

In other words, it was found out that even if the toner image is finished to a sufficient glossy image by the fixing device, for a free period of time ranging up to the subsequent cooling and solidification, the glossiness is reduced due to the cohesion or the like of the melted toner.

It should be noted that the mechanism for reducing the glossiness due to the operation of the conventional fixing device described above by the present invention is not intended to be limited to the fixing device of a two-roller system, and hence it may also be basically applied to a fixing device of a belt-roller nip system or a fixing device of a belt-belt nip system as well.

In addition, the present inventors found out that the toner immediately after the fixing is in a state of being able to be deformed by an external force for a short period of time ranging up to solidification by the subsequent natural cooling, and has viscosity of a level at which the toner is flowable by applying thereto a pressure.

In the light of the above-mentioned fact, the present inventors have gotten to devise the present invention capable of attaining the above-mentioned objects.

Therefore, according to the present invention, there is provided a fixing device for applying at least heat and a pressure to a recording material on which toner is carried in a shape of an image pattern to form an unfixed toner image to fix the unfixed toner image on the recording material to thereby obtain a toner image, the fixing device including:

a heating and temporarily fixing unit that applies at least heat to the unfixed toner image formed on the recording material to soften or melt the toner of the unfixed toner image into a state of being able to be deformed by an external force; and an image gloss control unit that, while the toner is maintained in the state of being able to be deformed by the external force by the heating and temporarily fixing unit, presses the toner in a nonheating manner to flow the toner.

According to the fixing device of the present invention, the image gloss control unit is provided as a unit for the subsequent process of the heating and temporarily fixing unit which generally becomes the fixing device in itself. Then, with the image gloss control unit, while held in a state of being able to be deformed by an external force, such as a melted state or a softened state, the toner carried on the surface of the recording material is pressed and flowed, thereby allowing the glossiness of the toner image to be enhanced. That is to say, since the image gloss control unit having a construction only adapted to press the toner in a nonheating manner is added to a conventional fixing device, the high glossiness can be realized with a simple apparatus construction without consuming any of wasteful energies.

In addition, since the surface state of the toner is smoothed to realize the high glossiness, no influence is exerted on the property itself of the toner and the recording material. Hence, it is possible to obtain an image of image quality excellent in transparency of a toner image and OHP permeability, and also curl is hardly caused in the recording material.

Moreover, the whole surface of the recording material is only finally and continuously pressed by the image gloss control unit. Thus, since the pressing nonuniformity hardly occurs, and of course, such a concept itself as nonuniformity due to imperfect tight contact is absent, the resultant image is free from the gloss nonuniformity.

In the fixing device of the present invention, the above-mentioned image gloss control unit can be made a unit which is composed of at least one pair of rotating bodies adapted to be rotated while being in press-contact with each other to form a pressing nip portion, and which serves to insert the recording material in which the toner of the unfixed toner image is maintained in the state of being able to be deformed by an external force into the pressing nip portion to thereby press and flow the toner. In that case, it is preferable to include a cooling unit that maintains surface temperatures of the at least one pair of rotating bodies at a predetermined temperature or lower. In addition, at least one of the at least one pair of rotating bodies is preferably constituted of at least abase layer and a releasing layer. It is more preferable that an elastic body layer is further formed between the base layer and the releasing layer. In this case, a surface hardness control layer is preferably further formed between the elastic body layer and the releasing layer. Also, an elastic modulus of a material of which the surface hardness control layer is made is desirably higher than that of each of materials of which the elastic body layer and the releasing layer are made, respectively. It is also a preferable aspect that the press-contact of the at least one pair of rotating bodies is made releasable, or a press-contact force of the at least one pair of rotating bodies is made variable.

It is preferable that the surface temperature of the toner after carrying out the processing by the image gloss control unit becomes lower than a temperature at which the toner can be deformed by an external force. The surface property of the toner image in which the surface is adjusted to enhance its glossiness after completion of the processing by the image gloss control unit can be prevented from being changed later.

In the fixing device of the present invention, the above-mentioned heating and temporarily fixing unit can be a unit that is composed of a heating rotating body and a pressing rotating body adapted to be rotated while press-contacting each other to form a fixing nip portion, and which serves to soften or melt the toner of the unfixed image after inserting the recording material having the unfixed toner image formed thereon into the fixing nip portion to provide a state in which the toner can be deformed by an external force. At this time, the applied pressure to the recording material in the image gloss control unit is preferably larger than that in the heating and temporarily fixing unit.

In the fixing device of the present invention, it is also a preferable aspect to have a fixing condition control mechanism for controlling at least one of a heating time and a heating temperature in the heating and temporarily fixing unit in correspondence to a kind of applied recording material.

Moreover, in the fixing device of the present invention, a heat insulating structure against the outside air is preferably provided between the heating and temporarily fixing unit and the image gloss control unit, or a heat holding unit that holds heat between the heating and temporarily fixing unit and the image gloss control unit is preferably provided.

Further, according to the present invention, there is provided a fixing method of applying at least heat and a pressure to a recording material on which toner is carried in a shape of an image pattern to form an unfixed toner image to fix the unfixed toner image on the recording material to thereby obtain a toner image, the fixing method including:

a heating and temporarily fixing process for applying at least heat to the unfixed toner image formed on the recording material to soften or melt the toner of the unfixed toner image into a state of being able to be deformed by an external force; and an image gloss control process for, while the toner is maintained in the state of being able to be deformed by an external force through the heating and temporarily fixing process, pressing the toner in a nonheating manner to flow the toner.

According to the fixing method of the present invention, the image gloss control process is provided as a unit for the subsequent process of the heating and temporarily fixing process which generally becomes the fixing device in itself. Then, by the image gloss control process, while maintaining a state of being able to be deformed by an external force, such as a melted state or a softened state, the toner carried on the surface of the recording material is pressed and flowed, thereby allowing the glossiness of the toner image to be enhanced. That is to say, since the image gloss control process having a construction only adapted to press the toner in a nonheating manner is added to a conventional fixing method, the high glossiness can be realized by a simple operation without consuming any of wasteful energies, thereby realizing high glossiness.

In addition, since the surface state of the toner is smoothed to realize the high glossiness, no influence is exerted on the property itself of the toner and the recording material. Hence, it is possible to obtain an image of image quality excellent in transparency of a toner image and OHP permeability, and also curl is hardly caused in the recording material.

Moreover, the whole surface of the recording material is only finally and continuously pressed by the image gloss control unit. Thus, since the pressing nonuniformity hardly occurs, and of course, such a concept itself as nonuniformity due to imperfect tight contact is absent, the resultant image is free from the gloss nonuniformity.

In the fixing method of the present invention, the above-mentioned image gloss control process can be a process in which the recording material for which a state of being able to deform the toner of the unfixed toner image by an external force is maintained is inserted into a pressing nip portion of at least one pair of rotating bodies being rotated while press-contacting each other to form the pressing nip portion to thereby press and flow the toner with an outer peripheral surface of one of the one pair of rotating bodies as the pressing surface. At this time, a surface temperature of the at least one pair of rotating bodies is preferably maintained at equal to or lower than a predetermined upper limit temperature. In addition, it is also a preferable aspect that the press-contact force of the at least one pair of rotating bodies is made variable in correspondence to a degree of a desired image glossiness.

It is preferable that the surface temperature of the toner after carrying out the processing in the image gloss control process becomes lower than a temperature at which the toner can be deformed by an external force. Then, the surface property of the toner image in which its surface is adjusted to enhance the glossiness after completion of the processing by the image gloss control process can be prevented from being changed later.

In the fixing process of the present invention, the above-mentioned heating and temporarily fixing process can be a process in which the recording material having the unfixed toner image formed thereon is inserted into a fixing nip portion between a heating rotating body and a pressing rotating body being rotated while press-contacting each other to form the fixing nip portion to soften or melt the toner of the unfixed toner image to provide a state in which the toner can be deformed by an external force. At this time, the applied pressure to the recording material in the image gloss control process is preferably higher than that in the heating and temporarily fixing process.

In the fixing method of the present invention, it is also a preferable aspect to control at least one of a heating time and a heating temperature in the heating and temporarily fixing process in correspondence to a kind of applied recording material.

Moreover, in the fixing method of the present invention, the heat of the recording material on which the unfixed toner image made of the toner in a softening or melting state is formed is preferably held between the heating and temporarily fixing process and the image gloss control process.

Finally, according to the present invention, there is provided an image forming apparatus including at least: an unfixed toner image forming unit that carries toner on a surface of a recording material in a shape of an image pattern to form an unfixed toner image; and a fixing unit that heats and presses the unfixed toner image held on the surface of the recording sheet to thereby fix the fixed toner image, in which the fixing unit is composed of the fixing device of the present invention. At this time, the unfixed toner image forming unit can be a unit that forms the unfixed toner image in accordance with an electrophotographic system.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Preferred embodiments of a fixing device and a fixing method of the present invention will hereinafter be described in detail with reference to the accompanying drawings, and then an image forming apparatus using the fixing device of the present invention will be described.

<Embodiment 1>

Figure 1:
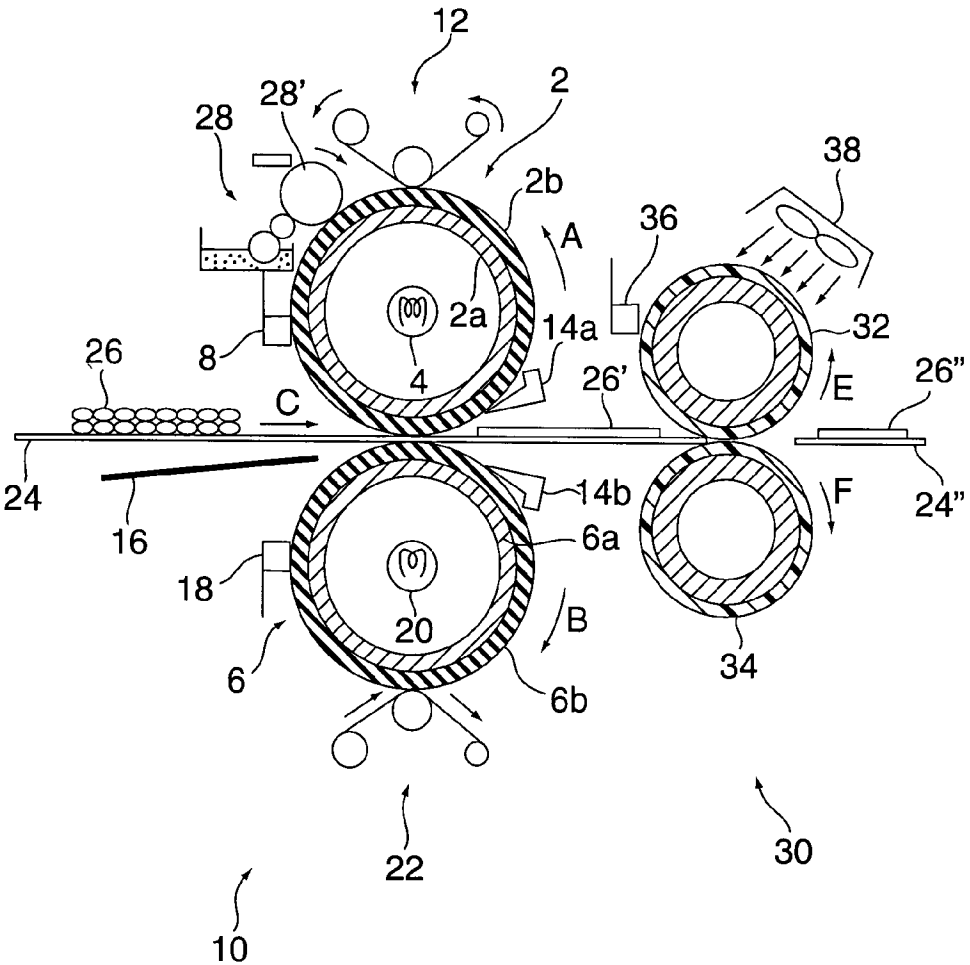
FIG. 1 is a schematic constructional view showing a fixing device according to a preferred embodiment of the present invention.

FIG. 1 shows a schematic constructional view of a fixing device of Embodiment 1 useful in explaining the fixing device and a fixing method of Embodiment 1. The fixing device of this embodiment is mainly constituted by a heating and temporarily fixing device (heating and temporarily fixing unit) 10 bearing a heating and temporarily fixing process, and an image gloss controller (image gloss control unit) 30 bearing an image gloss control process.

(Heating and temporarily fixing process and heating and temporarily fixing unit)

The heating and temporarily fixing device 10 has basically the same construction as that in a fixing device of a two-roller system which has been conventionally and generally used. The heating and temporarily fixing device 10, as a basic construction, includes a heating roll (heating rotating body) 2 and a pressure roll (pressing rotating body) 6 which are adapted to be rotated while press-contacting each other to form a fixing nip portion. Note that, "press-contact" described in the present invention is assumed to be the concept containing a case where those rolls press-contact each other through a recording material.

The heating roll 2 is rotated in a direction indicated by an arrow A and the pressure roll 6 is rotated in a direction indicated by an arrow B to follow the rotation of the heating roll 2 while the pressure roll 6 press-contacts the heating roll 2 to form therebetween a fixing nip portion. The heating roll 2, for example, is constructed by forming an elastic body layer **2*b* having heat resistance and made of a silicone rubber or the like on a periphery of a metal core 2*a* having a hollow cylindrical shape. A halogen heater 4 is self-contained in a hollow portion of the metal core 2*a* in order to supply the heat required for the fixing (temporary fixing). Although a surface temperature (fixing temperature) of the heating roll 2 varies with the toner used, in general, the surface temperature ranges from 150 to 200 degrees Celsius (° C.). In addition, a peripheral velocity of the heating roll 2**, in general, is selected from the range of 50 to 300 mm/sec.

The pressure roll 6 is constructed by forming a silicone rubber layer **6*b* on a periphery of a metal core 6*a* having a hollow cylindrical body shape similarly to the heating roll 2, and a halogen heater 20 is self-contained as a heat source in a hollow portion of the metal core 6*a***.

The control of surface temperatures of the rolls 2 and 6 is carried out as follows: A thermistor 8 is arranged as a temperature detection element so as to contact the heating roll 2, and a thermistor 18 is arranged as a temperature detection element so as to contact the pressure roll 6 in order to detect the surface temperatures of the rolls 2 and 6, respectively, due to a change in resistance value in accordance with the detected temperature. Then, a controller (not shown) controls turn-ON/OFF of the halogen heater 4 and a halogen heater 20 so that the surface temperatures of the rolls become predetermined values, respectively.

In addition, an oil application device 28 is arranged in the outer periphery of the heating roll 2. During the fixing, an oil application roll 28' of the oil application device 28 contacts the outer periphery of the heating roll 2 to be rotated to thereby apply oil such as silicone oil to the outer periphery. It should be noted that when toner having high melt viscosity is used as will be described later, or when a measure to cope with an oilless state is taken, this oil application device 28 is omitted.

A paper sheet (recording material) 24 on which an unfixed toner image 26 is formed by carrying toner in the shape of an image pattern through an arbitrary image forming process method such as electrophotography, electrostatic recording or magnetic recording is guided by a conveyance guide 16 to travel in a direction indicated by an arrow C from top left in the drawing to be inserted into the fixing nip portion between the heating roll 2 and the pressure roll 6. Then, after the heat and the pressure are applied to the unfixed toner image 26 from the surface of the heating roll 2 having a uniform oil layer formed thereon to be temporarily fixed, the recording material 24 is peeled off from the heating roll 2 and the pressure roll 6 by separation claws 14*a* and 14*b* to be discharged from the fixing nip portion between the heating roll 2 and the pressure roll 6.

The surface of the heating roll 2 after completion of the temporary fixing is rotated in the direction indicated by the arrow A to be slidingly rubbed again by a cleaning web 12 so that dirt of the offset toner and paper powders are removed and the excessive oil is removed. On the other hand, the surface of the pressure roll 6 is also slidingly rubbed again by a cleaning web 22 through the rotation in the direction indicated by the arrow B to remove dust, transferred toner and oil.

As for the toner constituting the unfixed toner image 26, there is especially no limit thereto. Thus, the general toner, i.e., the toner which has a binding resin (either a crystalline resin or an amorphous resin may be available) and coloring matter (mainly, pigment) as essential components, and has releasing agent (oil), charge control agent, foaming agent, fluidization agent, magnetic particles and the like internally added or inorganic or organic particles externally added as required is used without any problems.

As for the toner constituting the unfixed toner image 26, especially, the color toner, for the purpose of enhancing the color mixture, sharp-melt toner which has a low softening point and low melting viscosity is generally used. In this case, the high temperature offset to the heating roll 2 tends to occur. In order to prevent the high temperature offset, it is desired as in this embodiment to apply oil as releasing agent for enhancing releasing property, especially, silicone oil on a surface of the heating roll 2. In the case where the toner having high melt viscosity is used, such application of the oil becomes unnecessary. However, the color mixture is likely to become low, and a visibility of a picture image is likely to degrade. In addition thereto, in the case where an OHP paper sheet is used as the recording material, the light permeability is likely to degrade, and as a result, only a dark OHP projected image may be obtained in some cases.

In addition, the toner, according to a polymerization method, in which a low softening point material such as wax or paraffin having melting viscosity and a molecular weight smaller than that of a toner host resin is previously internally added as the releasing agent to the sharp-melt toner is used, or a releasing layer such as tetrafluoroethylene/perfluoroalkylvinylether copolymerization (PFA) or tetrafluoroethylene hexafluoropropylene copolymerization (FEP) is formed on a surface layer of at least one of the heating roll and the pressure roll to thereby take a measure for enhancing a releasing effect by the heating and temporarily fixing unit, thereby making it possible to realize an oilless state as well.

In general, the fixing property substantially meeting the requirement is obtained under the conditions in which the surface temperature of the heating roll 2 is set to fall within the range of 150 to 200 degrees as described above, the heating time (nip time) is set to fall within the range of 30 to 300 msec, and the applied pressure is in the range of 1.0 to 10 $kg/cm^2$.

When the toner is heated to be softened and melted in the above-mentioned fixing nip portion, the unfixed toner image 26 is pressed together with the paper sheet 24 between the heating roll 2 and the pressure roll 6. As a result, at least a part of the toner of the unfixed toner image 26 permeates into the surface layer of the paper sheet 24, and hence the adhesive strength and the fixing strength of the cooled and solidified toner against the paper sheet 24 are increased owing to the anchor effect due to the cooling and solidification of the permeated toner.

Along with the travel of the paper sheet 24 in the direction indicated by the arrow A, the temperature of the toner of the unfixed toner image 26 continuously rises from an inlet to an outlet of the above-mentioned fixing nip portion to become a maximum temperature at the outlet of the fixing nip portion. In general, the temperature at this time becomes 110 to 150 degrees under the above-mentioned conditions. Then, the toner of a semifixed toner image (in the present invention, it means a toner image in a state of being expressed in the shape of "an unfixed toner image composed of the toner in a softening or melting state") 26' on the surface of the paper sheet 24 discharged from the fixing nip portion is in a melting state, and hence is in a state of being able to be deformed by an external force.

Note that, it is also a preferable aspect to have a fixing condition control mechanism for controlling at least one of the heating time and the heating temperature in the heating and temporarily fixing device 10 as the heating and temporarily fixing unit in correspondence to a kind (a thickness, a material and a structure, such as, for example, a coat paper, a plain paper, an OHP paper or the like) of recording material applied as the paper sheet 24. At least one of the heating time and the heating temperature is controlled to allow the semifixed toner image 26' to get a stable state corresponding to a kind of recording paper sheet.

That is to say, when the recording material is thick, the heat capacity of the recording material itself becomes large. Hence, it is desirable to take at least one of a long heating time and a high heating temperature in the heating and temporarily fixing device 10 all the more. Thus, when at least one of the heating time and the heating temperature in the heating and temporarily fixing device 10 is held fixed, a state of the semifixed toner image 26' become diverse depending on a kind of recording material. As a result, it is also conceivable that the desired gloss state becomes difficult to be obtained in an image gloss control process as will be described later. Accordingly, as described above, it is also a preferable aspect to have the fixing condition control mechanism.

As for the fixing condition control mechanism, there is given: a mechanism in which a console panel to which an operator of an apparatus (a fixing device, or an image forming apparatus having the same. Hereinafter, it is also applied to the case where such an apparatus is referred to as "an apparatus" for short) can directly input information of a kind (a thickness, a material and a structure, coat paper, a plain paper, an OHP paper or the like) of a recording material is arranged in order to automatically adjust at least one of the heating time and the heating temperature in accordance with the input information, or a mechanism in which sensors for detection of a thickness, a specific gravity and the like of a recording material are arranged in a conveyance path of the recording material in an apparatus in order to automatically adjust at least one of the heating time and the heating temperature in accordance with the output information from the sensors.

Note that, the heating time finally means a nip time of the above-mentioned fixing nip portion. In the usual way, for control of the heating time, a nip width between the heating roll 2 and the pressure roll 6 is adjusted. On the other hand, the heating temperature means a temperature of the surface of the heating roll 2. In the usual way, for control of the heating temperature, turn-ON/OFF of the halogen heater 4 as the heat source is controlled, the intensity thereof is made variable, and so forth.

(Image Gloss Control Process and Image Gloss Control Unit)

A temperature of the semifixed toner image 26', in a melting state, peeled off from the heating roll 2 is reduced and the toner cohesive force is also increased as the heat radiates. Then, the free toner partially coheres to cause undulation on the surface of the semifixed toner image 26'. A height of the undulation reaches the range of submicron to several μm a level of which exerts a large influence on the image gloss. In particular, when the melt viscosity of the toner at the outlet of the above-mentioned fixing nip portion is low (in the melting state), the undulation becomes large, and as a result, a degree of reduction of the image glossiness due to the large undulation is increased. Thus, in the conventional fixing system, there is a limit to enhancement of the image glossiness.

In the present invention, attention is paid to the above-mentioned phenomenon, and undulation caused on the surface of the toner image due to the cohesion is corrected by the image gloss controller 30 as the image gloss control unit. The control for the image gloss needs to be carried out at least in a state in which the toner of the semifixed toner image 26' can be deformed by an external force.

Figure 2:
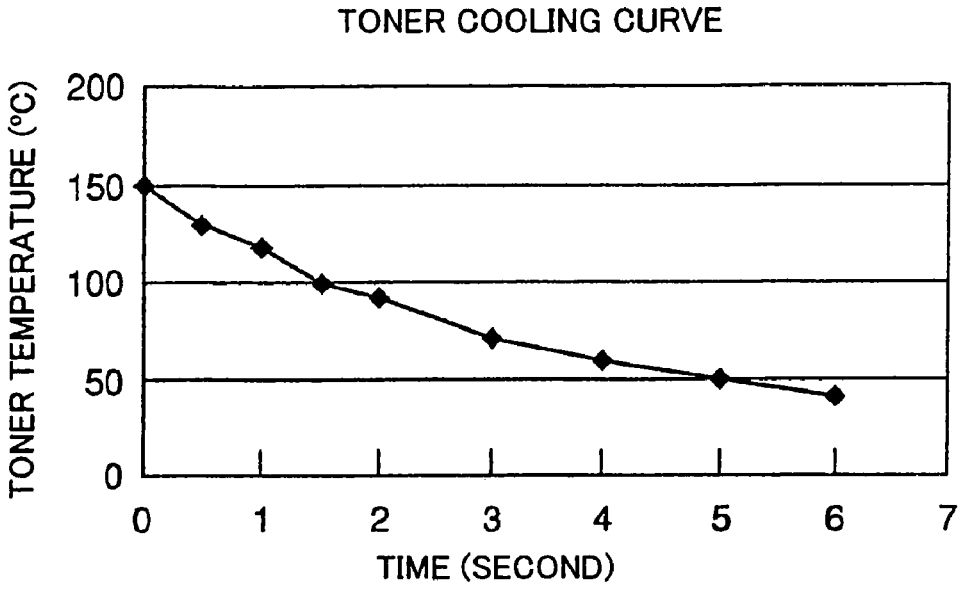
FIG. 2 is a graphical representation useful in explaining a toner cooling curve showing a tendency of a temperature of a surface of toner to drop at a moment and after peeling off the toner from a heating roll in the fixing device shown in FIG. 1.

FIG. 2 is a graphical representation (toner cooling curve) showing a tendency in which the surface temperature of the toner is reduced with a lapse of time with a moment of peeling off the toner from the heating roll 2 as the time origin (0 second) when the temperature of the toner at the outlet of the fixing nip portion is 150 degrees in this embodiment. From FIG. 2, it is understood that if a lapse of time is within about 4 seconds (desirably, within 1 second) from the time origin, then the toner temperature is equal to or higher than 80 degrees, and hence the toner holds its softening state. Also, if a lapse of time is within 1 second from the time origin, then the toner holds a melting state in which the toner temperature is equal to or higher than 120 degrees. From this, in this embodiment, when a fixing velocity is 125 mm/sec, for example, a distance between the heating and temporarily fixing device 10 and the image gloss controller 30 is made within 500 mm (desirably, within 125 mm) to allow the image gloss to be controlled.

In the present invention, the distance between the heating and temporarily fixing unit and the image gloss control unit must be made a distance within which the processing by the image gloss control unit is executed while there is maintained a state in which the toner of the unfixed toner image becoming a softening or melting state provided by the heating and temporarily fixing unit can be deformed by an external force.

Here, description will hereinbelow be given with respect to a definition of "a state of being able to be deformed by an external force" prescribed in the form of a state of the toner in the present invention. While "a state of being able to be deformed by an external force" literally means a state in which when a physical external force acts on the toner, a shape of the toner which is not yet solidified can be changed, a pressure is given as this "external force". Of course, when a very large pressure is applied to the toner, the toner as the resin composition is deformed even if it has previously attained a solidification state. However, such a large pressure is not contained in the above-mentioned definition. In that definition, a pressure having such a magnitude as in a nip pressure or so in a general fixing device is contained without any problems. More specifically, the definition of the "external force" in the above expression is made with a maximum value of a pressure which can be applied by the image gloss control unit in the constitution of the present invention.

In the other words, if in the process in which the toner is changed from a melting state to a softening state, and is further cooled so that its temperature becomes equal to or lower than "a softening point" to be finally solidified, when the toner is pressed with the pressing surface by the image gloss control unit in the constitution of the present invention, the toner is flowed to form a smooth surface to provide a state in which a highly glossy image is obtained, then the toner at this temperature can be defined as being in "a state of being able to be deformed by an external force".

The reason that "a state of being able to be deformed by an external force" of the toner can not be clearly defined with a temperature in such a manner is that since the toner is a composition made of plural materials, its melting point or softening point is not uniquely obtained, a degree of "a state of being able to be deformed by an external force" of the toner differs depending on the condition such as a magnitude, a time and an area of the pressure applied by the image gloss control unit, and so forth. However, considering the objects, operation and effects of the present invention, the temperature of the toner in "a state of being able to be deformed by an external force" is surely present differently from the melting point or softening point of the toner.

Note that, the temperature which is expressed as "a softening point" of the toner for the sake of convenience means the temperature which is required for the fixing of the toner at the minimum. At the fixing lower limit temperature, the viscosity may be decreased so as for the toner to be melted, and the viscosity of the toner may be decreased so as for the toner to be softened. Thus, even in the case where the temperature is expressed as a melting point for the sake of convenience when the toner is fixed, in actuality, the viscosity of the toner may be decreased so as for the toner to be softened. In addition, the softening means a state in which the viscosity in the softening is higher than that in the melting, and corresponds to the temperature at which when an external force is applied to the toner, the toner is deformed to be flowed without any problems. Such a softening state, of course, is contained in the temperature of "a state of being able to be deformed by an external force" in the above-mentioned definition. In the present invention, a state in which the viscosity is at least $1\times10^5$ Pa·sec is contained in "a state of being able to be deformed by an external force" of the toner, and a state in which the viscosity is at least $5\times10^3$ Pa·sec is more preferable.

In the case where a distance between the heating and temporarily fixing device 10 and the image gloss controller 30 needs to be lengthened in terms of a construction, it is preferable that a heat insulating structure against the outside air is adopted between the heating and temporarily fixing unit and the image gloss control unit, or a heat holding device for holding heat between the heating and temporarily fixing unit and the image gloss control unit is provided, whereby the heat of the paper sheet (recording material) 24 having the semifixed toner image 26' formed thereon is held between the heating and temporarily fixing process and the image gloss control process.

For adoption of the heat insulating structure against the outside air, there is given a method in which a conveyance region for the paper sheet 24 defined between the heating and temporarily fixing device 10 and the image gloss controller 30 is shielded (e.g., surrounded by wall materials made of metal sandwiching therebetween a heat insulating material such as glass wool) to suppress the heat radiation from the toner of the semifixed toner image 26' as much as possible. On the other hand, for the heat holding device, there is given a method in which a heater is provided in order to heat the toner of the semifixed toner image 26'. Of course, the provision of both the heat insulating structure and the heat holding device may also be available.

Holding the heat in such a manner allows a state in which the toner of the semifixed toner image 26' can be deformed by an external force to be maintained for a longer period of time. As a result, the distance between the heating and temporarily fixing device 10 and the image gloss controller 30 can be lengthened to some extent to increase the degree of freedom of the design of the apparatus.

As described above, while the state in which the toner of the semifixed toner image 26' can be deformed by an external force is maintained, the paper sheet 24 having the semifixed toner image 26' formed thereon is introduced into the image gloss controller 30 to be processed by the image gloss control unit (the image gloss control process). At this time, the toner of the semifixed toner image 26' is in a free state in which undulation is caused due to the cohesive force of the toner. However, the toner of the semifixed toner image 26' is flowed by the image gloss controller 30 so that the semifixed toner image 26' is adjusted into a shape having desirable image gloss. Also, at the same time, the heat energy is dissipated from the toner of the semifixed toner image 26' to cool the toner which is in turn solidified. Thus, a paper sheet (recording material) 24" is discharged in which a toner image 26" holding the resultant highly glossy state is formed without recohesion of the toner.

As shown in FIG. 1, the image gloss controller 30 is mainly constituted of a gloss control roll 32 and a pressing control roll 34 as one pair of rotating bodies adapted to be rotated while being in press-contact with each other to form a pressing nip portion. Unlike a normal fixing device, no heat source is arranged in the gloss control roll 32 nor the pressing control roll 34 at all. The gloss control roll 32 and the pressing control roll 34 are rotated in directions indicated by arrows E and F, respectively, at a linear velocity nearly equal to that of the rotation of the heating roll 2 and the pressing roll 6 in the previously mentioned heating and temporarily fixing device 10.

The gloss control roll 32 as the rotating body which is on a side being brought into press-contact with the semifixed toner image 26", i.e., a pressing surface is one roll which is longer than a width (in a direction perpendicular to the conveyance direction) of the paper sheet (recording material) 24 so as for its outer peripheral surface to be brought into press-contact with the whole region of the image surface of the surface of the recording material, and its surface is finished to a mirror surface state so as to be able to obtain a highly glossy image. On the other hand, the pressing control roll 34 opposite thereto has nearly the same length as that of the gloss control roll 32, and makes the semifixed toner image 26' on the surface of the paper sheet 24 tightly contact the gloss control roll 32 to control the glossiness of the image.

For a surface state of the gloss control roll 32, specifically, an arithmetical mean roughness Ra regulated in JIS B 0601 is preferably made equal to or smaller than 0.3 μm, and is more preferably made equal to or smaller than 0.1 μm.

In the case of a general plain paper, a surface of the toner, in an unfixed or semifixed state, formed on the surface of the general plain paper has irregularities of about several μm. For ensuring the adhesion between the gloss control roll 32 and the surface of the semifixed toner image 26' to follow such irregularities, preferably, the gloss control roll 32 has an elastic body layer. In this embodiment as well, there is adopted the gloss control roll 32 having an elastic body layer.

In addition, toner viscosity of the semifixed toner image 26' when being introduced into the image gloss controller 30 is higher than that of the toner, in the melting state, when being temporarily semifixed in the heating and temporarily fixing device 10. Surface hardness of the gloss control roll 32, and a nip pressure between the gloss control roll 32 and the pressure control roll 34 exert a large influence on the image glossiness of the finally obtained toner image 26". For obtaining the highly glossy image, it becomes necessary to use the gloss control roll 32 having high surface hardness to ensure a high nip pressure. Thus, it is desired for the gloss control roll 32 to have elasticity and high surface hardness. Accordingly, a gloss control roll having a construction of further covering the surface of the elastic body layer with a releasing layer formed of a thin resin layer is suitable therefor. In this embodiment as well, the gloss control roll 32 having such a construction is adopted.

Figure 3:
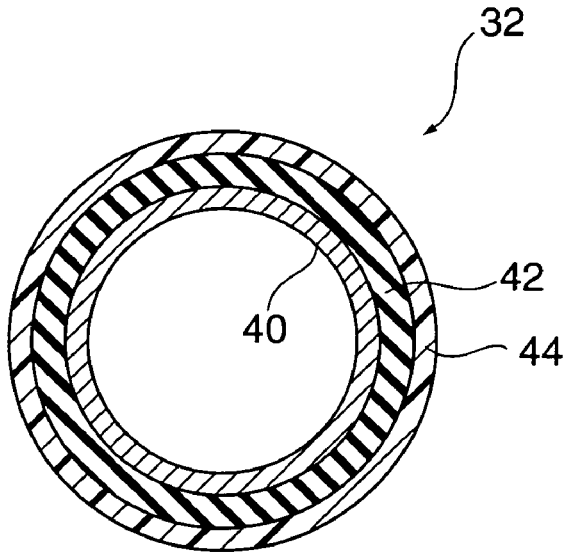
FIG. 3 is a schematic cross-sectional view useful in explaining a layer structure of a gloss control roll in the fixing device shown in FIG. 1.

FIG. 3 shows a schematic cross sectional view useful in explaining a layer structure of the gloss control roll 32 in this embodiment. As shown in FIG. 3, the gloss control roll 32 is constituted by a base layer 40, an elastic body layer 42 formed on an outer periphery of the base layer 40, and a releasing layer 44 formed on an outer periphery of the elastic body layer 42.

The base layer 40 is a hollow cylindrical metal core. Hence, a material which is used as a metal core of a fixing roll in a general fixing device can be used as it is. More specifically, for example, there is given a metal core made of stainless, aluminum, iron or copper. However, this member is not limited to metal. In addition, since the gloss control roll 32 is used in a nonheating state, a high heat resistance is not required therefor, and hence the gloss control roll 32 may be a cylindrical body made of any one of various kinds of resins.

The elastic body layer 42 is made of a material having rubber elasticity, and hence a material which is used for an elastic body layer of a fixing roll in a general fixing device can be used as it is. More specifically, for example, a silicone rubber, a fluoro rubber or the like is given.

A general purpose rubber can be used as a silicone rubber or a fluoro rubber as a material of the elastic body layer 42. For example, as for silicone rubbers, there can be utilized a vinylmethylsilicone rubber, a methylsilicone rubber, a phenylmethylsilicone rubber, a fluorosilicone rubber and the like. In addition, as for fluoro rubbers, there can be utilized a vinylidenfluoride series rubber, an ethylenetetrafluoride/propylene series rubber, an ethylenetetrafluoride/perfluoromethylvinylether rubber, a phosphazen series rubber, a fluoropolyether rubber and other fluoro rubbers. With respect to these materials, a single material or a combination of two or more materials may be available.

Various kinds of inorganic or organic fillers can be utilized for a silicone rubber or a fluoro rubber forming the elastic body layer 42. As for the inorganic fillers, there are given carbon black, titanium oxide, silica, silicon carbide, talc, mica, kaolin, iron oxide, calcium carbonate, calcium silicate, magnesium oxide, graphite, silicon nitride, boron nitride, iron oxide, aluminum oxide, magnesium carbonate and the like. In addition, as for the organic fillers, there can be utilized polyimide, polyamide-imide, polyether sulfone, polyphenylene sulfide, and the like.

In addition, as for special elastic bodies, polytetrafluoroethylene (PTFE), PFA and the like can be utilized as a fluoro resin.

As the elastic bodies used for the elastic body layer 42, the elastic body preferably has a relatively high impact resilience. Then, the elastic body having an impact resilience of equal to or larger than 40%, preferably equal to or larger than 50% is effective. Thus, from a viewpoint of an impact resilience, a silicone rubber is most preferable.

While a thickness of the elastic body layer 42 is not especially limited, in general, it is selected from the range of about 0.1 to about 5.0 mm.

The releasing layer 44 is preferably a resin layer having both the heat resistance and the releasing property. As for a specific material, a fluoro resin such as PTFE, PFA or FEP is suitable therefor. In particular, of them, PFA is most suitable therefor.

While a thickness of the releasing layer 44 is not especially limited, in general, it is selected from the range of about 0.03 to about 0.3 mm.

While above, the layer structure of the gloss control roll 32 has been described, the same layer structure can be applied to the pressing control roll 34. Of course, the above-mentioned layer structure may be applied to only one of these rolls. However, for obtaining the image gloss controller 30 which secures a sufficient press-contact pressure and is excellent in releasing property and smoothness, at least the gloss control roll 32 preferably has the above-mentioned layer structure.

In addition, for surface resiliences of the gloss control roll 32 and the pressure control roll 34, there is no need to provide a difference therebetween as in a relationship between a heating roll and a pressure roll in a general fixing device. In the general fixing device, for the purpose of securing a self-stopping property of a recording material, in general, there is a difference between surface resiliences of both the rolls. However, because the sufficient paper peeling property is secured in the image gloss controller 30, there is no need to provide such a resilience difference. If anything, it is preferable that the surface resiliences of both the rolls are made equal to each other. The reason for this will be described later.

In order to obtain a highly glossy image, it is desirable that the nip pressure in the pressing nip portion between the gloss control roll 32 and the pressing control roll 34 within the image gloss controller 30 is made at least higher than the nip pressure in the fixing nip portion of the heating and temporarily fixing device 10. The reason for this is that the toner viscosity in the image gloss control process is higher than that in the heating and temporarily fixing process, and hence the toner concerned is hardly flowed and also is changed from the melting-softening state to the solidification state in a short period of time.

It is preferable that the press-contact force (nip pressure) between the gloss control roll 32 and the pressing control roll 34 of the image gloss controller 30 is made variable. If the press-contact force concerned is made variable, then by adjusting the press-contact force, it is possible to control the image gloss state from a level at which a highly glossy image is not required so much to a level at which a highly glossy image is desired as in a photographic image. In addition, if the press-contact between the gloss control roll 32 and the pressure control roll 34 of the image gloss controller 30 is made releasable, in the case where increased high glossiness of an image is not required at all, or in the case where a glossless image is desired, it is possible to cope with these requests by releasing the above-mentioned press-contact.

In general, it is said that when the glossiness of the paper sheet 24" itself as the recording material is close in level to the glossiness of the toner image 26", there is no sense of incompatibility in an image. Consequently, for example, when a glossy paper sheet for printing is used as the recording material, the above-mentioned press-contact force is increased, while when a low glossy paper sheet such as a plain paper sheet is used, the above-mentioned press-contact force is decreased, or the press-contact force between the gloss control roll 32 and the pressing control roll 34 of the image gloss controller 30 is released, whereby it becomes possible to realize an image in a desired gloss state from a low glossy image to a highly glossy image.

The image gloss controller 30 also has a function of, while the paper sheet 24 having the semifixed toner image 26' formed thereon is passed through the pressing nip portion between the gloss control roll 32 and the pressing control roll 34, radiating the heat of the semifixed toner image 26' in a state of being able to be deformed by an external force to cool and solidify the toner. This cooling and solidification prevent the toner from being flowed so that the toner image 26" is fixed. In addition, while the paper sheet 24 having the semifixed toner image 26' formed thereon is passed through the pressing nip portion, the cohesive force of the toner has already become large and thus, the toner is readily peeled off from the gloss control roll 32. During the peeling-off, the toner of the toner image 26" is sufficiently solidified so that the adhesive strength and the fixing force of the toner against the paper sheet 24" become very large, while the adhesion thereof to the gloss control roll 32 becomes very small. Thus, there is hardly any fear that the toner offset against the gloss control roll 32 occurs.

At this time, it is preferable that as described above, the surface resiliences of the gloss control roll 32 and the pressing control roll 34 are made equal to each other. When the surface resiliences of both the rolls are nearly equal to each other, the surfaces of the gloss control roll 32 and the pressing control roll 34 are equally deformed, and as a result, the shape of the pressing nip portion formed at this time becomes nearly a plane. Thus, the paper sheet 24" is hardly made to curl when it is inserted into the pressing nip portion and discharged. Moreover, even when the paper sheet 24 curls in the heating and temporarily fixing device 10, the paper sheet 24 holds its planar shape within the pressing nip portion having a nearly planar shape to correct its curl to be discharged to a discharge tray (not shown). Consequently, it may be safely said that the image gloss control unit of the present invention also has a function of a paper sheet discharging device.

Note that, while in the above description, the toner is expressed as being in the "solidification" state or in the "solid state" for the sake of convenience in some cases, it may be proper for the toner to be described as being in the increased high viscosity state rather than in the solidification state or in the solid state. Then, in the present invention, the state of the high viscosity rather than "a state of being able to be deformed by an external force" described above is defined as the "solidification" state or "the solid state".

When the paper sheets 24 on each of which the semi-fixed toner image 26' is formed with the toner in a state of being able to be deformed by an external force are continuously inserted into the image gloss controller 30, the temperatures of the gloss control roll 32 and the pressure control roll 34 gradually rise due to the heat energy of the semi-fixed toner image 26', causing such an assumption that the toner temperature at the outlet of the pressing nip portion becomes equal to or higher than a softening point of the toner concerned. In this case, the surface of the toner image 26" which is already smoothed recoheres, causing problems such as a degree of glossiness is reduced, the paper sheet becomes difficult to be peeled off from the gloss control roll 32 due to the adhesive strength of the toner, and so forth. In order to prevent such problems, it is preferable that the surface of the gloss control roll 32 is forcibly cooled to maintain its temperature at a level equal to or lower than a predetermined temperature.

In this embodiment, as shown in FIG. 1, an air cooling fan (cooling unit) 38 for forcibly cooling the surface of the gloss control roll 32 is provided. The surface of the gloss control roll 32 is cooled by blowing thereto a current of air using the air cooling fan 38 to maintain a temperature of the surface of the gloss control roll 32 at a level equal to or lower than a predetermined temperature. Note that, the air cooling fan 38 has only to be activated when the temperature of the surface of the gloss control roll 32 rises due to the operation of the apparatus. Hence, in this embodiment, turn-ON/OFF of the air cooling fan 38 is controlled in accordance with a signal outputted from the temperature sensor 36 for detecting a temperature of the surface of the gloss control roll 32.

In this embodiment, the air cooling fan for forcibly cooling only the surface of the gloss control roll 32 is adopted. However, an air cooling fan for forcibly cooling the surface of the pressing control roll 34 may also be installed. Even if only the air cooling fan is adopted due to the limitation of the design of the apparatus, a certain cooling effect can be expected.

With the above-mentioned construction, it becomes possible for the fixing device to maintain stable performance. In addition, the range of recording materials to be used is also widened to make it possible to meet various needs.

The above-mentioned "equal to or lower than a predetermined temperature", at which the surface of the gloss control roll 32 should be maintained, is preferably such a temperature that the surface temperature of the toner in the toner image 26", after the image gloss controller 30 carries out the processing therefor, becomes lower than the temperature at which the toner can be deformed by an external force. Of course, if the image gloss controller 30 is constructed such that the surface temperature of the toner concerned becomes lower than the temperature at which the toner can be deformed by an external force, then it is not particularly necessary to provide a special cooling unit in the present invention. More specifically, for example, there are given such constructions that a constituent element having a very large heat capacity is used as at least one of the gloss control roll 32 and the pressing control roll 34, at least one of the gloss control roll 32 and the pressing control roll 34 is exposed to the outside air to allow the heat to be sufficiently radiated, and so forth.

A specific value of the above-mentioned "equal to or lower than a predetermined temperature", while it depends on various kinds of conditions, is preferably set equal to or lower than 100° C., and is more preferably set equal to or lower than 80° C.

According to this embodiment, as described above, it is possible to obtain the image which has the image quality excellent in transparency of the toner image and OHP permeability, and which has the high glossiness and also is free from gloss nonuniformity with the simple apparatus construction, and moreover, curls are hardly caused in the recording material. In addition, the fixing device of this embodiment is constructed only by adding the image gloss controller 30, which merely do pressure application, to the heating and temporarily fixing device 10 that has the same construction as a normal fixing device. Hence, not only the apparatus is simple in construction, but also no wasteful energy is consumed since the heating energy is the same as that in a conventional apparatus. Moreover, the control can be carried out to obtain desired glossiness.

<Embodiment 2>

Figure 4:
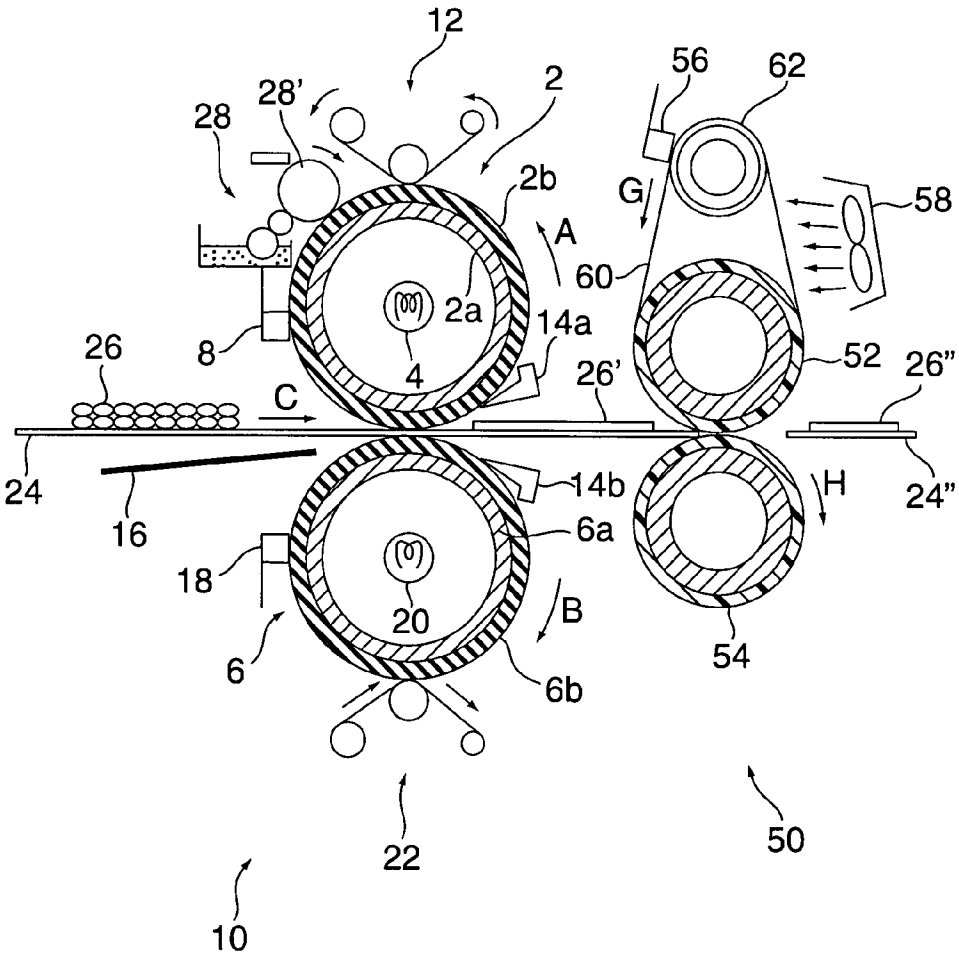
FIG. 4 is a schematic constructional view showing a fixing device according to another preferred embodiment of the present invention.

FIG. 4 shows a schematic constructional view of a fixing device of Embodiment 2 useful in explaining the fixing device and a fixing method of Embodiment 2. The fixing device of this embodiment, similarly to Embodiment 1, mainly includes the heating and temporarily fixing device (heating and temporarily fixing unit) 10 bearing a heating and temporarily fixing process, and an image gloss controller (image gloss control unit) 50 bearing an image gloss control process.

In this embodiment, a construction of the image gloss controller (image gloss control unit) 50 bearing the image gloss control process is different from that in Embodiment 1, but a construction of the heating and temporarily fixing device (heating and temporarily fixing unit) 10 bearing the heating and temporarily fixing process is basically the same as that in Embodiment 1. Thus, only a feature of this embodiment different from that of Embodiment 1 is shown in the section (Image Gloss Control Process and Image Gloss Control Unit) described below. In addition, in FIG. 4, the members having the same functions as those in Embodiment 1 are designated with the same reference numerals, and the detailed description thereof is omitted here.

(Image Gloss Control Process and Image Gloss Control Unit)

The semifixed toner image 26' is formed on the surface of the paper sheet 24 by the heating and temporarily fixing device 10, similarly to Embodiment 1. After that, while the toner concerned is maintained in a state of being able to be deformed by an external force, the paper sheet 24 having the semifixed toner image 26' formed thereon is introduced into the image gloss controller 50 to be processed by the image gloss control unit (Image Gloss Control Process).

(1) The state of the toner of the semifixed toner image 26', (2) the distance, (3) the heat insulating structure and a heat holding unit, and the like from the heating and temporarily fixing device 10 to the image gloss controller 50 are the same as those in Embodiment 1.

During the processing by the image gloss control unit, the toner of the semifixed toner image 26' is in a free state in which undulation is caused due to the cohesive force of the toner. However, the toner of the semifixed toner image 26' is flowed by the image gloss controller 50 so that the toner of the semifixed toner image 26' is adjusted into a shape having desirable image gloss. Also, at the same time, the heat energy is dissipated from the toner of the semifixed toner image 26' to cool the toner which is in turn solidified. Thus, a paper sheet (recording material) 24" is discharged in which a toner image 26" holding the resultant highly glossy state is formed without recohesion of the toner.

In this embodiment, for one of the one pair of rotating bodies in the image gloss controller 50, a gloss control belt 60 which is stretched around two stretch rolls 52 and 62 is used instead of the gloss control roll in Embodiment 1. The other of the one pair of rotating bodies is a pressing control roll 54. Since the pressing control roll 54 is the same in construction as the pressing control roll 34, the description thereof is omitted here for the sake of simplicity.

The stretch roll 52, which receives a load of the pressing control roll 54, may be the same in construction as the pressing control roll 54, or may be different therefrom. In this embodiment, as for the stretch roll 52, a roll which has the same size and construction as those of the pressing control roll 54, more specifically, a cylindrical body made of stainless is used. The other stretch roll (steering roll) 62 is a cylindrical body made of stainless, for example. A longitudinal one end of the stretch roll 62 is constructed so as to be able to change its position. The position of the end portion of the gloss control belt 60 is detected to thereby move the position of the end portion concerned to control the walk of the gloss control belt 60. As in Embodiment 1, no heat source is provided in the image gloss controller 50 of this embodiment.

The gloss control belt 60 and the pressing control roll 54 are rotated in directions indicated by arrows G and H, respectively, at a linear velocity which is nearly equal to that in the rotation of the heating roll 2 and the pressure roll 6 in the heating and temporarily fixing device 10 previously stated.

A surface of the gloss control belt 60 is finished to a mirror state so as to obtain a highly glossy image. A specific preferable surface state of the gloss control belt 60 is the same as that of the gloss control roll 32 in Embodiment 1. In addition, the gloss control belt 60 is also preferably constituted by a base layer, an elastic body layer and a releasing layer. The elastic body layer may be omitted.

A strip body made of metal (nickel, stainless or the like), a heat resistance resin (polyamide resin, polyimide resin, a PEEK (polyetheretherketone) resin, a PPS (polyphenylene sulfide) resin or the like) is used for the base layer.

A way of thinking with respect to the elastic body layer and the releasing layer above is the same as that described in Embodiment 1. However, thicknesses of the elastic body layer and the releasing layer are selected from the range of smaller values. More specifically, the thickness of the elastic body is generally selected from the range of about 0.03 to about 0.5 mm, and the thickness of the releasing layer is generally selected from the range of about 0.03 to about 0.3 mm. Note that, a way of thinking with respect to the surface elasticities of the gloss control belt 60 and the pressing control roll 54 is also basically the same as that in Embodiment 1. However, the gloss control belt 60 needs to be grasped as in the form of a surface elasticity of the whole construction including the stretch roll 52.

The press-contact force (magnitude, variable and release) between the gloss control belt 60 and the pressing control roll 54, the function of cooling and solidification (easiness of peeling-off) and the like are the same as those in Embodiment 1. Therefore, the description thereof is omitted here for the sake of simplicity.

In addition, similarly to Embodiment 1, the cooling unit for forcibly cooling the surface of the gloss control belt 60 is provided in order to make the surface temperature of the gloss control belt 60 equal to or lower than a predetermined temperature, and the operation and effects thereof are basically the same as those in Embodiment 1. However, in this embodiment, the arrangement of the cooling unit is different. An air cooling fan 58 as the cooling unit blows a current of air to the surface of the gloss control belt 60 to cool the surface thereof in order that a temperature of the surface of the gloss control belt 60 may be maintained at a level equal to or lower than a predetermined temperature. The construction and the control of the air cooling fan 58 are the same as those in Embodiment 1.

In Embodiment 2 as described above, similarly to Embodiment 1, it is possible to obtain the image which has the image quality excellent in transparency of the toner image and OHP permeability, and which has the high glossiness and also is free from gloss nonuniformity with the simple apparatus construction, and moreover, curl is hardly caused in the recording material. In addition, the fixing device of this embodiment is constructed only by adding the image gloss controller 50, which merely do pressure application, to the heating and temporarily fixing device 10 that has the same construction as a normal fixing device. Hence, not only the apparatus is simple in construction, but also no wasteful energy is consumed since the heating energy is the same as that in a conventional apparatus. Moreover, the control can be carried out so as to obtain desired glossiness.

<Embodiment 3>

Figure 8:
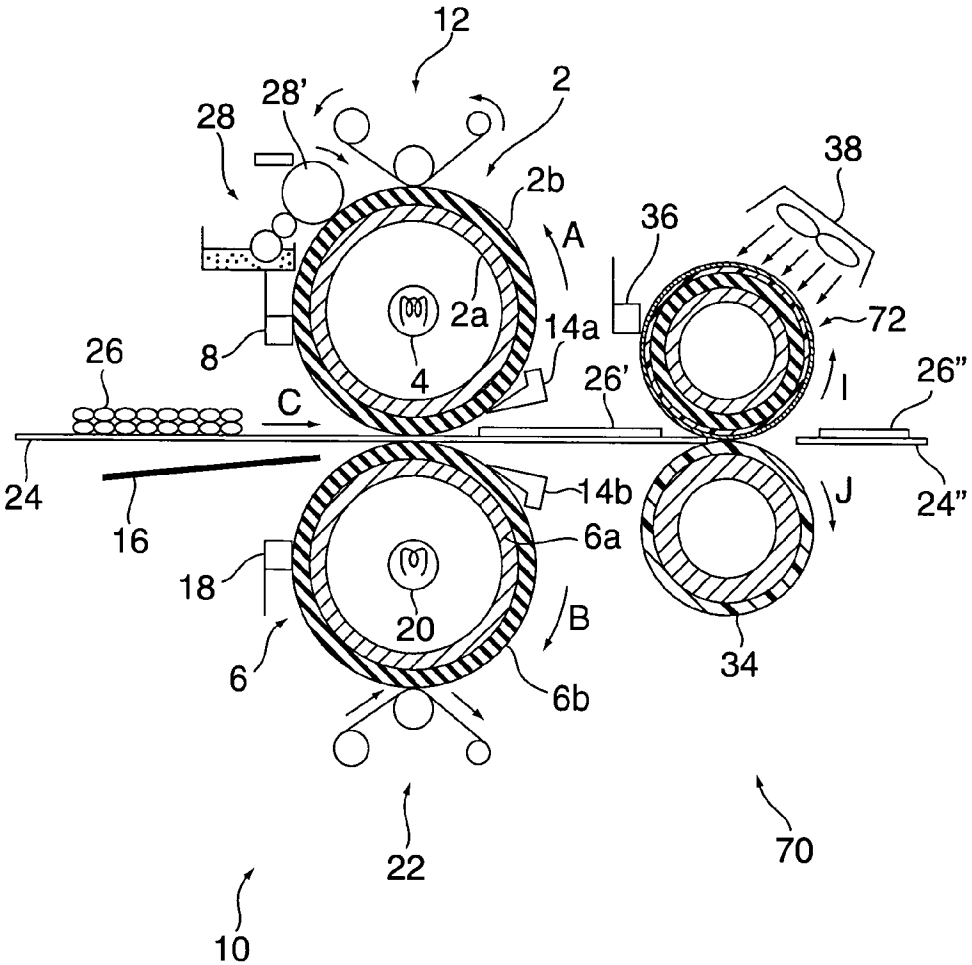
FIG. 8 is a schematic constructional view showing a fixing device according to another preferred embodiment of the present invention.

FIG. 8 shows a schematic constructional view of a fixing device of Embodiment 3 useful in explaining a fixing device and a fixing method of Embodiment 3. The fixing device of this embodiment, similarly to Embodiment 1, mainly includes the heating and temporarily fixing device (heating and temporarily fixing unit) 10 bearing a heating and temporarily fixing process, and an image gloss controller (image gloss control unit) 70 bearing an image gloss control process.

In this embodiment, the construction of the image gloss controller (image gloss control unit) 70 bearing the image gloss control process is different from that in Embodiment 1, but the construction of the heating and temporarily fixing device (heating and temporarily fixing unit) 10 bearing the heating and temporarily fixing process is basically the same as that in Embodiment 1. Thus, only a feature of this embodiment different from that of Embodiment 1 is shown in the section (Image Gloss Control Process and Image Gloss Control Unit) described below. In addition, in FIG. 8, the members having the same functions as those in Embodiment 1 are designated with the same reference numerals, and the detailed description thereof is omitted here.

(Image Gloss Control Process and Image Gloss Control Unit)

The semifixed toner image 26' is formed on the surface of the paper sheet 24 by the heating and temporarily fixing device 10, similarly to Embodiment 1. After that, while the toner concerned is maintained in a state of being able to be deformed by an external force, the paper sheet 24 having the semifixed toner image 26' formed thereon is introduced into the image gloss controller 70 to be processed by the image gloss control unit (Image Gloss Control Process).

(1) The state of the toner of the semifixed toner image 26', (2) the distance, (3) the heat insulating structure and the heat holding unit, and the like from the heating and temporarily fixing device 10 to the image gloss controller 70 are the same as those in Embodiment 1.

During the processing by the image gloss control unit, the toner of the semifixed toner image 26' is in a free state in which undulation is caused due to the cohesive force of the toner. However, the toner of the semifixed toner image 26' is flowed by the image gloss controller 70 so that the toner of the semifixed toner image 26' is adjusted into a shape so as to have desirable image gloss. Also, at the same time, the heat energy is dissipated from the toner of the semifixed toner image 261 to cool the toner which is in turn solidified. Thus, a paper sheet (recording material) 24" is discharged in which a toner image 26" holding the resultant highly glossy state is formed without recohesion of the toner.

In this embodiment, for one of the one pair of rotating bodies in the image gloss controller 70, a gloss control roll 72 having a surface hardness control layer provided between a releasing layer and an elastic body layer is used instead of the gloss control roll 32 in Embodiment 1. The other of the one pair of rotating bodies is the pressing control roll 34.

Figure 9:
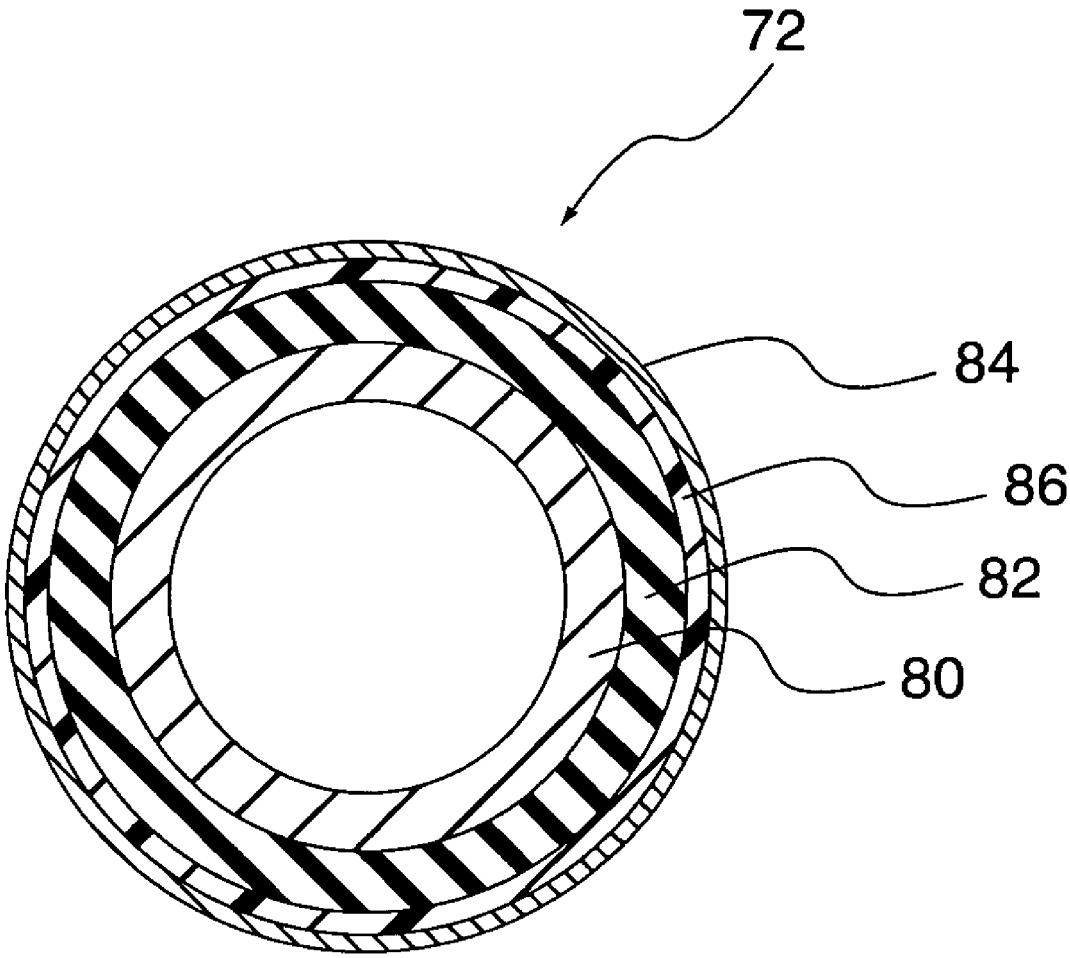
FIG. 9 is a schematic cross sectional view useful in explaining a layer structure of a gloss control roll in the fixing device shown in FIG. 8.

FIG. 9 shows a schematic cross sectional view useful in explaining a layer structure of the gloss control roll 72 in this embodiment. As shown in FIG. 9, the gloss control roll 72 is constituted by a base layer 80, an elastic body layer 82 formed on an outer periphery of the base layer 80, a releasing layer 84 formed on an outer periphery of the elastic body layer 82, and a surface hardness control layer 86 formed between the elastic body layer 82 and the releasing layer 84.

The gloss control roll 72 and the pressing control roll 34 are rotated in directions indicated by arrows I and J, respectively, at a linear velocity which is nearly equal to that in the rotation of the heating roll 2 and the pressure roll 6 in the heating and temporarily fixing device 10 previously stated.

A surface of the gloss control roll 72 is finished to a mirror state so as to obtain a highly glossy image. A specific preferable surface state of the gloss control roll 72 is the same as that of the gloss control roll 32 in Embodiment 1.

The base layer 80 is a hollow cylindrical metal core. A metal core of a fixing roll in a general fixing device can be used as the base layer 80. More specifically, for example, there is given a metal core made of stainless, aluminum, iron or copper. However, the material is not limited to metal. In addition, since the gloss control roll 72 is used in a non-heating state, high heat resistance is not required therefor, and hence the gloss control roll 32 may be formed of a cylindrical body made of any one of various kinds of resins.

The elastic body layer 82 is made of a material having rubber elasticity. A material used for an elastic body layer of a fixing roll in a general fixing device can be used for the elastic body layer 82. More specifically, for example, a silicone rubber, a fluoro rubber or the like can be given.

A general purpose silicone rubber or fluoro rubber can be used as a material of the elastic body layer 82. As a silicone rubber, a vinylmethylsilicone rubber, a methylsilicone rubber, a phenylmethylsilicone rubber, a fluorosilicone rubber or the like can be utilized. As a fluoro rubber, a vinylidenfluoride series rubber, an ethylenetetrafluoride/propylene series rubber, an ethylenetetrafluoride/perfluoro-methylvinylether rubber, a phosphazen series rubber, a fluoropolyether rubber and other fluoro rubbers can be utilized. With respect to these materials, a single material or a combination of two or more materials may be utilized.

Various kinds of inorganic or organic fillers can be utilized for a silicone rubber or a fluoro rubber forming the elastic body layer 82. As an inorganic filler, carbon black, titanium oxide, silica, silicon carbide, talc, mica, kaolin, iron oxide, calcium carbide, calcium silicate, magnesium oxide, graphite, silicon nitride, boron nitride, iron oxide, aluminum oxide, magnesium carbonate and the like can be utilized. As an organic filler, polyimide, polyamidoimide, polyether sulfone, polyphenylene sulfide and the like can be utilized.

In addition to this, as special elastic bodies, polytetrafluoroethylene (PTFE), PFA and the like can be utilized as a fluoro rubber.

It is preferable that an elastic body used for the elastic body layer 82 has a relatively high impact resilience. The elastic body having an impact resilience of equal to or higher than 40%, preferably equal to or higher than 50% is effective. Thus, from a viewpoint of the impact resilience, a silicone rubber is the most preferable.

A thickness of the elastic body layer 82 is not especially limited. In general, it is selected from the range of about 0.1 to about 5.0 mm.

The surface hardness control layer 86 is preferably a thin film layer having heat resistance, and the flexibility adapted not to impede deformation of the elastic body layer underlying the surface hardness control layer 86 so much. It is desirable from a viewpoint of increasing the glossiness that an elastic modulus of a material that forms the surface hardness control layer 86 is larger than an elastic modulus of each of the materials that form the releasing layer 84 overlying the surface hardness control layer 86, and the elastic body layer 82 underlying the surface hardness control layer 86, respectively.

In this embodiment, the elastic modulus of the material that forms the elastic body layer 82 is preferably in the range of about 1 to about 10 Mpa, and the elastic modulus of a fluoro resin that forms the releasing layer 84 is preferably in the range of about 300 to about 700 Mpa. Considering this relationship, in this embodiment, the elastic modulus of the material that forms the surface hardness control layer 86 is preferably equal to or larger than 1 Gpa, and more preferably, equal to or larger than 3 Gpa.

A thickness of the surface hardness control layer 86 is preferably selected from the range of about 0.01 to about 0.1 mm in order to have such flexibility as not to impede so much the deformation of the elastic body layer 82 underlying the surface hardness control layer 86.

For a specific material that forms the surface hardness control layer 86, a heat resistance resin (a polyamide resin, a polyimide resin, a PEEK (polyetheretherketone) resin, a PPS (polyphenylene sulfide) resin or the like), or metal (nickel, stainless or the like) can be suitably utilized.

The releasing layer 74 is preferably a resin having releasing property as well as heat resistance. Specifically, a fluoro resin such as a PTFE resin, a PFA resin or a FEP resin is suitable. In particular, the PFA resin is the most suitable of them. A thickness of the releasing layer 74 is not especially limited. In general, it is selected from the range of about 0.03 to about 0.3 mm.

The fixing device and the fixing method of the present invention have been described above with reference to the accompanying drawings and by giving the three embodiments in which the shapes, the arrangement and the like of the members are specified to some extent. However, it should be noted that the constitutions of the above-mentioned embodiments merely show one example of the present invention, and hence the present invention is not intended to be limited to the description of these embodiments. Thus, those skilled in the art can add changes and other constituent elements to the present invention on the basis of the conventional well known knowledge without departing from the scope including the constitution of the present invention. In such cases, of course, these changes and other constituent elements also belong to the category of the present invention.

For example, in the above-mentioned embodiments, for the heating and temporarily fixing unit, a device having the same construction as that in the fixing device of the so-called two-roller system is given as an example. However, the present invention is not intended to be limited thereto. That is to say, a device having the same constitution as that in a fixing device of a heating pressing system such as a roll-belt nip system, or a belt-belt nip system can be adopted for the heating and temporarily fixing unit without causing any problems. Also, a device having such a construction that an unfixed toner image is merely heated and melted as in heating such as oven-fixing or radiant fixing can be adopted for the heating and temporarily fixing unit without causing any problems because the unfixed toner image is pressed in the subsequent image gloss control process (image gloss control unit).

In addition, all the findings for the conventionally known fixing devices may also be added. The oil application device, the cleaning web, the temperature detection elements (temperature sensors), the conveyance guide, the separation claws, the cooling unit and the like illustrated in the drawings of the above-mentioned embodiments are appendant elements in the present invention. Thus, the present invention may of course be constituted without those appendant elements.

<Image Forming Apparatus of the Present Invention>

An image forming apparatus of the present invention includes at least an unfixed toner image forming unit that makes a surface of a recording material carry toner in the shape of an image pattern to form an unfixed toner image, and a fixing unit that heats and presses the unfixed toner image carried on the surface of the recording material to fix the unfixed toner image, in which the fixing unit is the above-mentioned fixing device of the present invention. The fixing device of the present invention is as stated above.

Any construction may be adopted for an unfixed toner image forming device as long as it enables an unfixed toner image to be formed on a surface of a recording material by using the image formation process method such as electrophotography, electrostatic recording or magnetic recording. However, it is preferable to adopt the electrophotographic system with which an image can be stably, simply formed with a low cost and at a high speed.

A construction adapted to form an unfixed toner image on a surface of a recording material by the electrophotographic system is not especially limited. However, in general, the construction includes a cylindrical electrophotographic photosensitive body, and other constituent elements that are arranged in order in the circumference of the cylindrical electrophotographic photosensitive body, which are as follows: a charger for uniformly charging a surface of the cylindrical electrophotographic photosensitive body with electricity; a latent image formation apparatus for exposing an image pattern to form a latent image on the surface of the cylindrical electrophotographic photosensitive body, a developer for developing the formed latent image with toner to obtain an unfixed toner image, a transferring apparatus for transferring the resultant unfixed toner image onto a surface of a recording material, cleaning equipment for removing the toner and dusts remaining on the surface of the cylindrical electrophotographic photosensitive body after the transfer; and an electric charge removing apparatus for removing a residual electric potential on the surface of the electrophotographic photosensitive body. These constituent elements, i.e., the electrophotographic photosensitive body, the charger, the latent image forming apparatus, the developer, the transferring apparatus, the cleaning equipment, and the electric charge removing apparatus are not especially limited in the present invention. Thus, constituent elements each having any of the conventionally known constitutions may be used without causing any problems.

EXAMPLES

Next, the present invention will hereinafter be more specifically described by giving the following examples. It should be noted, however, that the present invention is not intended to be limited to the following examples.

Example 1

In Example 1, a fixing device having the same construction as that in Embodiment 1 described above, i.e., the construction shown in FIG. 1, was manufactured. The detailed specifications are as follows.

(Heating and Temporarily Fixing Device 10)

The heating roll (heating rotating body) 2: Its diameter is 50 mm and its length is 350 mm. It is formed by coating a cylindrical substrate made of aluminum as the metal core 2*a* with a silicone rubber layer having a thickness of 3 mm and a high heat conductivity as the elastic body layer 2*b*.

The pressure roll (pressure rotating body) 6: Its diameter is 50 mm and its length is 350 mm. It is formed by coating a cylindrical substrate made of aluminum as the metal core 6*a* with a silicone rubber layer having a thickness of 1.5 mm and a high heat conductivity as the elastic body layer 6*b*.

The fixing nip portion between the heating roll 2 and the pressure roll 6: In the fixing nip portion formed between the heating roll 2 and the pressure roll 6 under a press-contact state, the elastic body layer 2*b* of the heating roll 2 is largely depressed (since the elastic body layer 2*b* of the heating roll 2 is largely depressed, the paper sheet 24 tends to be peeled off along a direction for winding around the pressure roll 6). Its nip width is 8.0 mm.

The linear velocities in rotation of the heating roll 2 and the pressure roll 6: 125 mm/sec.

The press-contact force between the heating roll 2 and the pressure roll 6: The total load is 120 kg.

The surface temperatures of the heating roll 2 and the pressure roll 6: Turn-ON/OFF of the halogen heaters 4 and 20 is controlled in accordance with the detection signals outputted from thermistors 8 and 18 such that their surface temperatures are held at 200° C. and at 190° C., respectively.

The oil application device 28: Dimethyl silicone oil is supplied as the oil.

The oil application roll 28': It is formed by providing the elastic body layer (silicone rubber) to the surface of the roll substrate made of stainless. The oil from an oil pan is supplied to the surface of the heating roll 2 through plural rolls to uniformly form the oil film.

(Image Gloss Controller 30)

The distance between the heating and temporarily fixing device 10 and the image gloss controller 30: The image gloss controller 30 is arranged such that the head of the pressing nip portion between the gloss control roll 32 and the pressing control roll 34 is located at the position 42 mm behind the fixing nip portion between the heating roll 2 and the pressure roll 6. It takes about 0.33 seconds to arrange the image gloss controller 30.

The gloss control roll 32: Its diameter is 30 mm. It is formed by covering the base layer 40 made of stainless with a silicone rubber (rubber hardness is 60° C. (JIS-A)) having a thickness of 2 mm as the elastic body layer 42 and further with a highly glossy PFA tube having a thickness of 100 μm (the arithmetical mean roughness Ra of a surface is equal to or smaller than 0.1 μm) as the releasing layer 44.

The pressing control roll 34: Its diameter is 30 mm. Similarly to the gloss control roll 32, it is formed by covering the base layer 40 made of stainless with a silicone rubber (rubber hardness is 60° C. (JIS-A)) with 2 mm thickness as the elastic body layer 42 and further with a highly glossy PFA tube with 100 μm thickness (the arithmetical mean roughness Ra of a surface is equal to or smaller than 0.1 μm) as the releasing layer 44. Its surface temperature is 60° C. (JIS-A) which is higher than that of the heating roll 2.

The nip width of the pressing nip portion between the gloss control roll 32 and the pressing control roll 34: 2.5 mm.

The press-contact force between the image gloss controller 32 and the pressing control roll 34: The total load is 130 kg.

The relationship between the surface elasticities of the gloss control roll 32 and the pressing control roll 34: These surface elasticities are nearly equal to each other.

The paper sheet (recording material) 24 having the unfixed toner image 26 formed thereon was inserted into and passed through the fixing device having the above construction to fix the toner. Note that, J paper (A4 size) manufactured by Fuji Xerox Co., Ltd. was used as the paper sheet 24, and color toner for DCC400CP manufactured by Fuji Xerox Co., Ltd. (toner for DCC400CP manufactured by Fuji Xerox Co., Ltd.) was used for forming the unfixed toner image 26. Then, a weight of the toner for each color is 4 g/m$^2$, and the toner for all colors having a weight of 12 g/m$^2$ was formed at a center portion of the paper sheet having a size of 10×10 cm.

The surface temperature of the toner of the semifixed toner image 26' immediately after discharge from the outlet of the fixing nip portion of the heating and temporarily fixing device 10 was 150° C. At this temperature, the toner is in a melting state. Thereafter, the toner of the semifixed toner image 26' was passed from the heating and temporarily fixing device 10 to the image gloss controller 30 while radiating the heat and cohering due to the ambient atmosphere to reach the inlet of the pressing nip portion of the image gloss controller 30 after a lapse of 0.33 seconds. The toner temperature at this time was 135° C., and hence the toner was still in the melting state. Also, at this temperature, the toner is in a state of being able to be deformed by an external force.

Then, after the paper sheet was inserted into and passed through the pressing nip portion of the image gloss controller 30, it is brought into press-contact with the surface of the gloss control roll 32, and the toner suffered an operation of the nip pressure of about 16 kg/cm$^2$. Since the surface of the gloss control roll 32 has the elasticity, it follows a stepped portion of the semifixed toner image 26' and irregularities of the paper sheet 24 to satisfactorily tightly contact the semifixed toner image 26' and the paper sheet 24.

Within the pressing nip portion, the heat of the toner of the semifixed toner image 26' was absorbed by the gloss control roll 32 at a low temperature, and the toner was speedily cooled down to about 70° C. Likewise, the heat held by the paper sheet 24 is mainly absorbed by the pressing control roll 34 in the pressing nip portion. The toner of the semifixed toner image 26' cooled down to 70° C. was no longer flowed nor showed the adhesive strength to become a solidification state. Thus, the paper sheet 24" was peeled off without winding around the gloss control roll 32 at the outlet of the pressing nip portion to be discharged in a state in which the surface of the toner image 26" after the peeling-off did not cohere to maintain the high glossiness. Note that, the gloss control roll 32 and the pressing control roll 34 became depressed by the same quantity so that the pressing nip portion became a planar shape, and hence the paper sheet 24 curled at the fixing nip portion of the heating and temporarily fixing device 10 was corrected to be discharged in a planar state.

When the paper sheets 24 are continuously fed to the fixing device of this example to be inserted into and passed through the image gloss controller 30, in the case where the image gloss controller 30 does not have the air cooling fan (cooling unit) 38, heat is gradually accumulated in the image gloss controller 32 and the pressing control roll 34 of the image gloss controller 30 to raise temperatures thereof. If such a temperature exceeds a temperature at which the toner becomes a state of being able to be deformed by an external force, then even if the paper sheet 24 having the toner image 26' formed thereon is inserted into and passed through the pressing nip portion of the image gloss controller 30, the toner is not sufficiently solidified. As a result, there may occur a phenomenon that the toner image 26' winds around the gloss control roll 32 or the image glossiness is slightly reduced.

In order to prevent such a phenomenon from occurring, in this example, the air cooling fan (cooling unit) 38 is installed in the image gloss controller 30 such that a temperature of the toner of the toner image 26" is constantly maintained at equal to or lower than the temperature at which the toner becomes a state of being able to be deformed by an external force at the outlet of the pressing nip portion. The air cooling fan 38 is controlled in accordance with the detection signal outputted from the temperature sensor 36 such that a surface temperature of the gloss control roll 32 is held at 60° C. or less.

Figure 5:
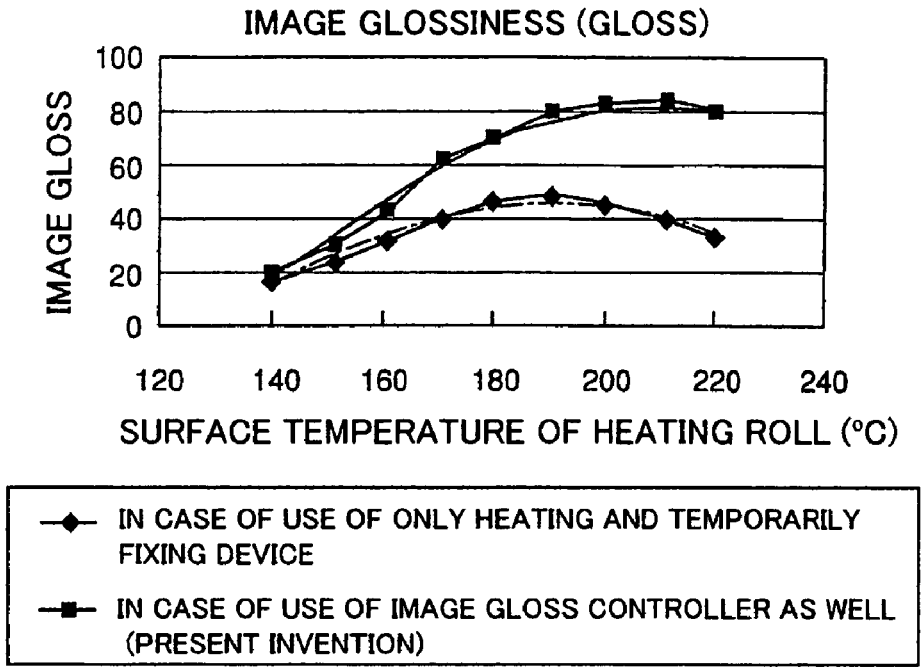
FIG. 5 is a graphical representation showing the results obtained by measuring glossiness (an image gloss) of a toner image in Example 1 while changing a temporarily fixing temperature in both the case where only a heating and temporarily fixing device is used and the case (the present invention) where the heating and temporarily fixing device and an image gloss controller are used together.
Figure 6:
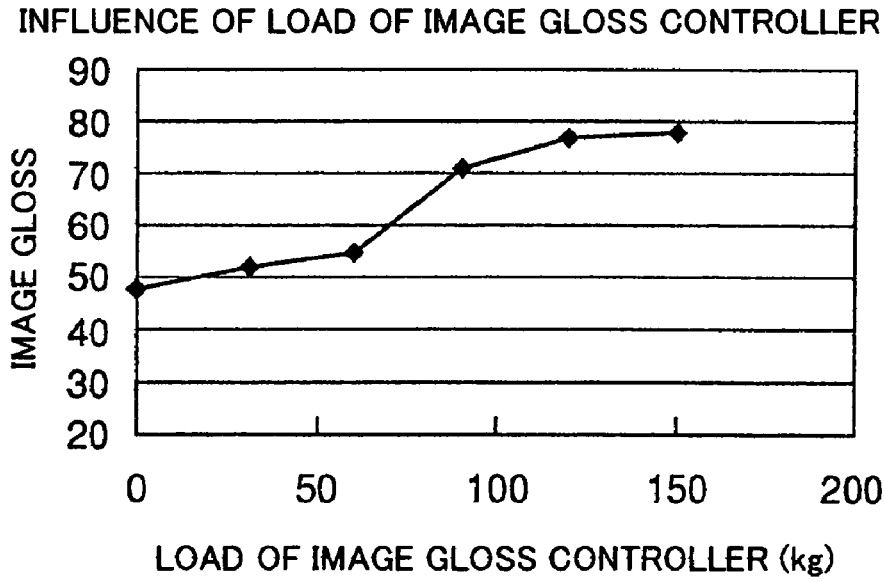
FIG. 6 is a graphical representation showing the results obtained by measuring the glossiness (image gloss) of a toner image in Example 1 while changing a load of the image gloss controller.
Figure 7:
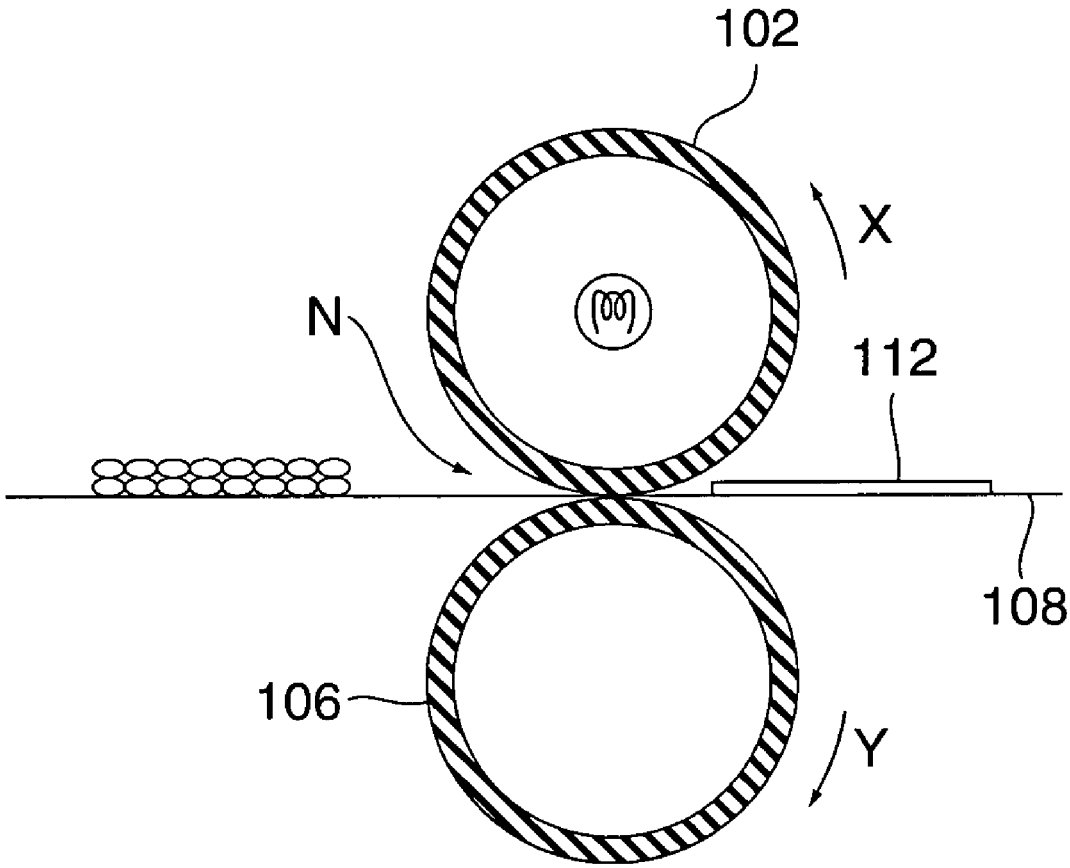
Fig. 7 RELATED ART
FIG. 7 is a schematic constructional view of a general fixing device of a two-roller system.

FIG. 5 is a graphical representation showing the results obtained by measuring the glossiness (image gloss) of the resultant toner image 26" which was measured while changing a temporarily fixing temperature (a surface temperature of the heating roll 2) of the heating and temporarily fixing device 10 in both the case (the present invention) where only the heating and temporarily fixing device 10 was used and case where the image gloss controller 30 was used together with the heating and temporarily fixing device 10. Also, FIG. 6 is a graphical representation showing the results obtained by measuring the glossiness (image gloss) of the toner image 26" in the case where a load of the image gloss controller 30 is changed from 0 kg to 150 kg.

As can be understood from the graph shown in FIG. 5, the glossiness of the toner image when only the heating and temporarily fixing device 10 was used had an image gloss of 48 (at 200° C. in surface temperature of the heating roll 2 in the heating and temporarily fixing device 10 and at 190° C. in surface temperature of the pressure roll 6) according to the reading of a 75°—75° gloss meter, while the image gloss controller 30 was used together with the heating and temporarily fixing device 10 to thereby increase the image gloss of the toner image up to 78. In other words, it is understood that the effect of increasing the glossiness by the image gloss of about 30 can be obtained by use of the image gloss controller 30.

When the surface of the toner image 26" is magnified for observation, it is understood that fine undulation (irregularities) at a pitch of about 0.5 mm is present over the entire surface of the toner image 26" when only the heating and temporarily fixing device 10 was used, while such undulation (irregularities) disappears when the image gloss controller 30 was used together with the heating and temporarily fixing device 10, and hence the surface state of the toner image 26" was extremely smooth. As a result, it is understood that this effect is offered in the form of an increase in glossiness.

In addition, curl of about 8 to 10 mm in the paper sheet 24" caused through the processing by the heating and temporarily fixing device 10 was corrected down to a degree of 0 to 3 mm after the paper sheet 24" was passed through the image gloss controller 30. As a result, an increase in image quality and an improvement in accommodation to a paper tray were both realized.

A temperature of the discharged paper sheet 24" was equal to or lower than 60° C., thereby avoiding a problem in that blocking of paper sheets is caused inside a paper tray (not shown).

Example 2

In Example 2, a fixing device having the same construction as that in Embodiment 2 described above, i.e., the construction shown in FIG. 4, was manufactured. Example 2 is different from Example 1 only in the construction of the image gloss controller 50, and other constituent elements and set parameters thereof are the same as those in Example 1. The detailed specifications of the image gloss controller 50 are as follows.

(Image Gloss Controller 50)

The distance between the heating and temporarily fixing device 10 and the image gloss controller 50: The image gloss controller 50 is arranged such that the head of the pressing nip portion between the gloss control belt 60 and the pressing control roll 54 is located at the position 42 mm behind the fixing nip portion between the heating roll 2 and the pressure control roll 6. It takes about 0.33 mm seconds to arrange the image gloss controller 50.

The gloss control belt 60: It is obtained by forming PFA with a 50 μm thickness as the releasing layer on the base layer as an endless polyimide belt which has a diameter of 60 mm in terms of a circle and a thickness of 0.075 mm to be finished to a highly glossy surface (the arithmetical mean roughness Ra of a surface is equal to or smaller than 0.1 μm).

The pressing control roll 54: It is formed in the same manner as the pressing control roll 34 of Example 1.

The stretch roll 52: It is formed in the same manner as the pressing control roll 54.

The stretch roll 62: It is a stainless roll with a 25 mm diameter.

The press-contact force between the gloss control belt 60 and the pressing control roll 54: Its total load is 150 kg.

The paper sheet (recording material) 24 having the unfixed toner image 26 formed thereon was inserted into and passed through the fixing device having the above construction to fix the toner. The used paper sheet 24, toner, and the formed image are the same as those in Example 1.

The toner temperature of about 135° C., when the unfixed toner image 26' reached the inlet of the pressing nip portion of the image gloss controller 50 as well as the toner surface temperature of 150° C. of the unfixed toner image 26' immediately after passing through the outlet of the fixing nip portion of the heating and temporarily fixing device 10 was the same as that in Example 1. At this temperature, the toner was still in a melting state. Also, at this temperature, the toner is in a state of being able to be deformed by an external force.

Then, when the paper sheet 24 is inserted into and passed through the pressing nip portion of the image gloss controller 50, it is brought into press-contact with a surface of the gloss control belt 60, and the toner suffers an operation of the nip pressure of about 17 kg/cm$^2$. Since the stretch roll 52 has the elasticity, it follows a stepped portion of the semifixed toner image 26' and irregularities of the paper sheet 24 through the gloss control belt 60 to satisfactorily tightly contact the semifixed toner image 26' and the paper sheet 24'.

Within the pressing nip portion, the heat of the toner of the semifixed toner image 26' was absorbed by the gloss control belt 60 and the stretch roll 52 at a low temperature, and the toner concerned, similarly to Example 1, was speedily cooled down to about 70° C. The toner of the semifixed toner image 26' cooled down to 70° C. was no longer flowed nor showed the adhesive strength to become a solidification state. Thus, the paper sheet 24" was peeled off without winding around the gloss control belt 60 at the outlet of the pressing nip portion to be discharged in a state in which the surface of the toner image 26" after the peeling-off did not cohere to maintain the high glossiness.

In this example as well, similarly to Example 1, an air cooling fan (cooling unit) 58 is installed in the image gloss controller 50 so that the temperature of the toner of the toner image 26" always at the outlet of the pressing nip portion becomes equal to or lower than the temperature at which the toner becomes a state of being able to be deformed by an external force. The air cooling fan 58 was controlled in accordance with the detection signal outputted from the temperature sensor 56 so that a temperature of the outer peripheral surface of the gloss control belt 60 became equal to or lower than 70° C.

Similarly to Example 1, when the image gloss was measured, the glossiness of the toner image when only the heating and temporarily fixing device 10 was used had an image gloss of 48 (at 200° C. in surface temperature of the heating roll 2 in the heating and temporarily fixing device 10 and at 190° C. in surface temperature of the pressure roll 6) according to the reading of the 75°—75° gloss meter, while the image gloss controller 50 was used together with the heating and temporarily fixing device 10 (present invention) to thereby increase the image gloss of the toner image up to 82. In other words, it is understood that the effect of increasing the glossiness by the image gloss of about 32 can be obtained by use of the image gloss controller 50. Note that, the reason that an increase in glossiness is larger than that in Example 1 is that the surface hardness of the image gloss controller 60 is higher than that of the gloss control roll 32 used in Example 1.

As described above, even if the rotating body used for control of the glossiness is either of a roll-like or of a belt-like shape, the sufficiently increased high glossiness can be realized.

Example 3

In Example 3, a fixing device having the same construction as that in Embodiment 3 described above, i.e., the construction shown in FIG. 8 was manufactured. Example 3 is different from Example 1 only in the construction of the image gloss controller 50, and other constituent elements and set parameters thereof are the same as those in Example 1. The detailed specifications of the image gloss controller 50 are as follows.

(Image Gloss Controller 70)

The distance between the heating and temporarily fixing device 10 and the image gloss controller 70: The image gloss controller 70 is arranged such that the head of the pressing nip portion between the gloss control roll 72 and the pressing control roll 34 is located at the position 42 mm behind the fixing nip portion between the heating roll 2 and the pressure control roll 6. It takes about 0.33 seconds to arrange the image gloss controller 70.

The gloss control roll 72: Its diameter is 30 mm. It is formed by covering the base layer 80 made of stainless with a silicone rubber (rubber hardness is 60° C. (JIS-A)) having a thickness of 2 mm as the elastic body layer 82, providing a polyimide layer having a thickness of 50 μm as the surface hardness control layer 86 on the elastic body layer 82, and further covering the surface hardness control layer 86 with a highly glossy PFA tube having a thickness of 50 μm (the arithmetical mean roughness Ra of a surface is equal to or smaller than 0.1 μm) as the releasing layer 84.

The pressing control roll 34: Its diameter is 30 mm. Similarly to the gloss control roll 72, it is formed by covering the base layer 80 made of stainless with a silicone rubber (rubber hardness is 60° C. (JIS-A)) having a thickness of 2 mm as the elastic body layer 82, providing a polyimide layer with a 50 μm thickness as the surface hardness control layer 86 on the elastic body layer 82, and further covering the surface hardness control layer 86 with a highly glossy PFA tube with a 50 μm thickness (the arithmetical mean roughness Ra of a surface is equal to or smaller than 0.1 μm) as the releasing layer 84. Its surface hardness is 70° C. (JIS-A) which is higher than that of the heating roll 2.

The nip width of the pressing nip portion between the gloss control roll 72 and the pressing control roll 34: 2.2 mm.

The press-contact force between the image gloss controller 72 and the pressing control roll 34: The total load is 150 kg.

The relationship between the surface elasticities of the gloss control roll 72 and the pressing control roll 34: These surface elasticities are nearly equal to each other.

The paper sheet (recording material) 24 having the unfixed toner image 26 formed thereon was inserted into the fixing device having the above construction to fix the toner. Note that, J paper (A4 size) manufactured by Fuji Xerox Co., Ltd. was used as the paper sheet 24, and color toner for DCC400CP manufactured by Fuji Xerox Co., Ltd. (toner for DCC400CP manufactured by Fuji Xerox Co., Ltd.) was used for formation of the unfixed toner image 26. Then, the weight of each color toner was 4 g/m$^2$, and the total weight 12 g/m$^2$ of toner was formed in a size of 10×10 cm at a center portion of the paper sheet.

The surface temperature of the toner of the semifixed toner image 26' immediately after discharge from the outlet of the fixing nip portion of the heating and temporarily fixing device 10 was 150° C. At this temperature, the toner is in a melting state. Thereafter, the toner of the semifixed toner image 26' was passed from the heating and temporarily fixing device 10 to the image gloss controller 70 while radiating the heat and cohering due to the ambient atmosphere to reach the inlet of the pressing nip portion of the image gloss controller 70 after a lapse of 0.33 seconds. The toner temperature at this time was 135° C., and hence the toner was still in the melting state. Also, at this temperature, the toner is in a state of being able to be deformed by an external force.

Then, after the paper sheet 24 was inserted into the pressing nip portion of the image gloss controller 70, it was brought into press-contact with the outer peripheral surface of the gloss control roll 72, and the toner suffered an operation of the nip pressure of about 21 kg/cm$^2$. Since the surface of the gloss control roll 72 has elasticity, it followed a stepped portion of the semifixed toner image 26' and irregularities of the paper sheet 24 to tightly contact the semifixed toner image 26' and the paper sheet 24.

Within the pressing nip portion, the heat of the toner of the semifixed toner image 26' was absorbed by the gloss control roll 32 having a low temperature, and the toner was cooled down to about 70° C. in a very short time. Similarly, the heat of the paper sheet 24 is mainly absorbed by the pressing control roll 34 in the pressing nip portion. The toner of the semifixed toner image 26' cooled down to 70° C. was no longer flowed or showed adhesive strength, and became a solidification state. Thus, the paper sheet 24" was peeled off without twining round the gloss control roll 32 at the outlet of the pressing nip portion, and was discharged in a state in which the surface of the toner image 26" after the peeling-off did not cohere and high glossiness was maintained. Note that, the gloss control roll 32 and the pressing control roll 34 became depressed by the same quantity so that the pressing nip portion became a planar shape and hence the paper sheet 24 curled at the fixing nip portion of the heating and temporarily fixing device 10 was corrected to be discharged in a planar state.

When the paper sheets 24 are continuously fed to the fixing device of this example and inserted into the image gloss controller 30, in the case where the image gloss controller 70 does not have the air cooling fan (cooling unit) 38, the gloss control roll 72 and the pressing control roll 34 of the image gloss controller 70 are gradually heated so that their temperatures rise. Then, if the temperatures exceed the temperature at which the toner becomes a state of being able to be deformed by an external force, then even when the paper sheet 24 having the toner image 26' formed thereon is inserted into the pressing nip portion of the image gloss controller 70, the toner is not sufficiently solidified. As a result, a phenomenon occurs that the toner image 26' winds round the gloss control roll 72 or its image glossiness is slightly reduced.

In order to prevent such a phenomenon from occurring, in this example, the air cooling fan (cooling unit) 38 is installed in the image gloss controller 70 so that a temperature of the toner of the toner image 26" always becomes equal to or lower than the temperature at which the toner becomes a state of being able to be deformed by an external force at the outlet of the pressing nip portion. The air cooling fan 38 is controlled in accordance with the signal outputted from the temperature sensor 36 so that a temperature of the outer peripheral surface of the gloss control roll 32 becomes equal to or lower than 60° C.

Figure 10:
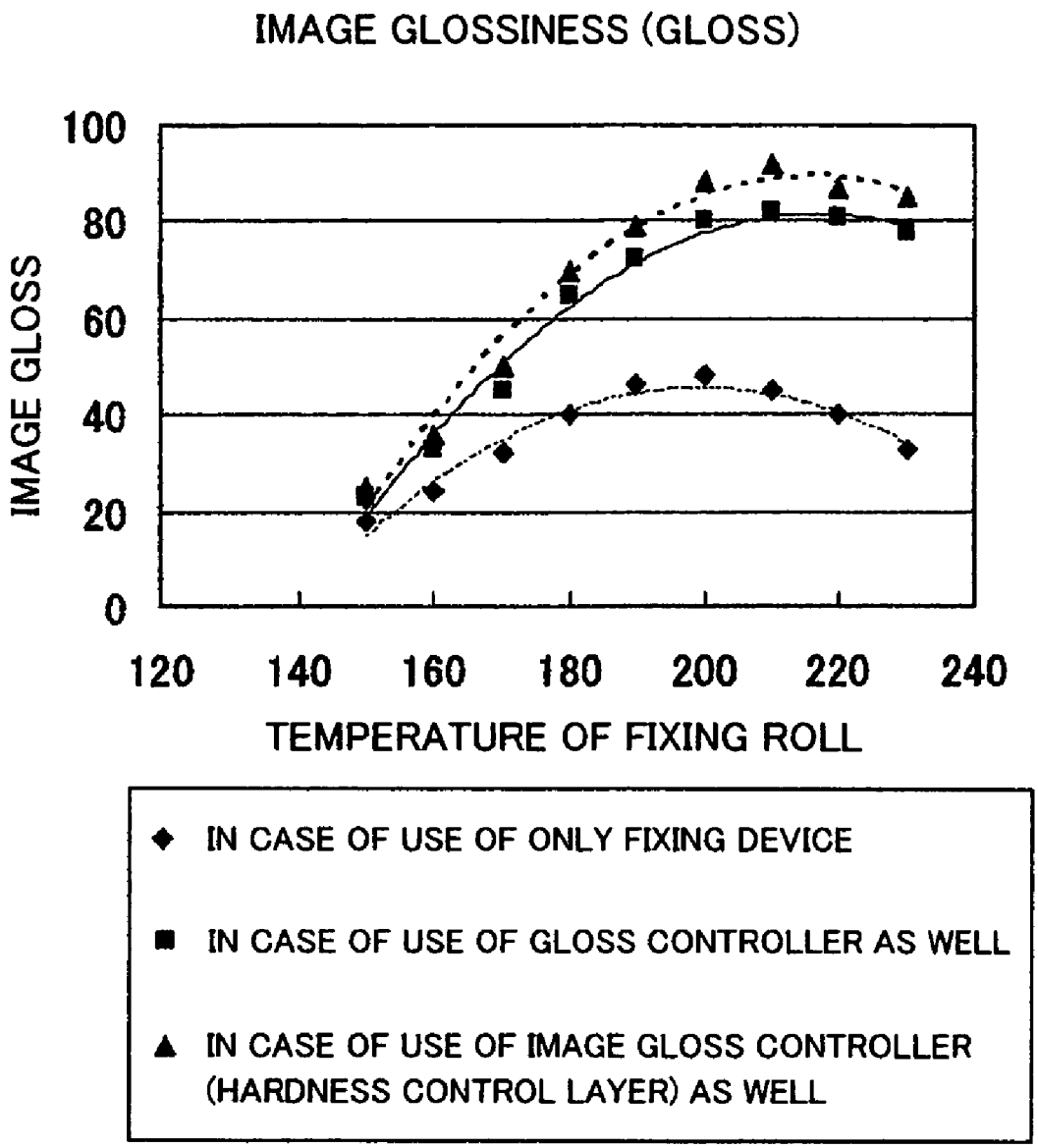
FIG. 10 is a graphical representation showing the results obtaining by measuring the glossiness (image gloss) of a toner image in Example 3 while changing a temporarily fixing temperature in both the case where only a heating and temporarily fixing device is used and the case (the present invention) where an image gloss controller is also used together.

FIG. 10 is a graphical representation showing the results obtained by measuring the glossiness (image gloss) of the resultant toner image 26" while changing a temporarily fixing temperature (a surface temperature of the heating roll 2) of the heating and temporarily fixing device 10 with respect to both cases where only the heating and temporarily fixing device 10 was used and where the image gloss controller 70 was used together with the heating and temporarily fixing device 10 (present invention).

As can be understood from the graph shown in FIG. 10, the glossiness of the toner image when only the heating and temporarily fixing device 10 was used was measured as image gloss 48 (the surface temperature of the heating roll 2 in the heating and temporarily fixing device 10 was 200° C. and the surface temperature of the pressure roll 6 was 190° C.) with a 75°—75° gloss meter, whereas in the case where the image gloss controller 70 was used together with the heating and temporarily fixing device 10 (present invention), the image gloss of the toner image was increased up to 92. In other words, it is understood that the effect of increasing the glossiness by image gloss of about 44 can be obtained by use of the image gloss controller 70.

The increase in glossiness when the gloss control roll 32 was used in Example 1 was 34, whereas the increase in glossiness in this example was 44. The reason for this is considered as follows: since in this example, the gloss control roll 72 has the polyimide layer (surface hardness control layer 86) having a large elastic modulus formed between the releasing layer 84 and the elastic body layer 82, the effect of increasing the glossiness is enhanced all the more as compared with Example 1.

When the surface of the toner image 26" is magnified for observation, it is understood that fine undulation (irregularities) at a pitch of about 0.5 mm is present over the whole surface of the toner image 26" when only the heating and temporarily fixing device 10 was used, whereas such undulation (irregularities) disappears when the image gloss controller 70 was used together with the heating and temporarily fixing device 10 (present invention), and the surface of the toner image 26" is very smooth. Therefore, it is understood that this brings the effect of an increase in glossiness.

In addition, similarly to Example 1, curl of about 8 to about 10 mm in the paper sheet 24" caused through the processing by the heating and temporarily fixing device 10 was corrected down to a level of 0 to 3 mm after the paper sheet 24" has passed through the image gloss controller 70. An increase in image quality and an improvement in accommodation to a paper tray were thus realized.

A temperature of the discharged paper sheet 24" was equal to or lower than 60° C., and blocking of paper sheets was not caused inside a paper tray (not shown).

As set forth hereinabove, according to the present invention, the glossiness of the toner image obtained after the fixing can be controlled from the start from low glossiness to high glossiness. In addition, the generation of the toner offset is reliably prevented to enable the satisfactory image fixing processing free from nonuniformity. Thus, the present invention is excellent in all respects as compared with the conventionally known and variously proposed gloss increasing unit and gloss control unit.

According to the present invention, glossiness equal to that obtained by utilizing the conventional method in which toner of a toner image is cooled in a state of tightly contacting a fixing belt using the fixing belt and then is peeled off can be stably obtained from the start. In addition, as compared with the conventional case, the energy is not wastefully consumed and the high speed operation is possible, the toner image in a softening and melting state through the heating can be reliably cooled with the simple construction, and curl is prevented from being caused in a recording material.

According to the present invention, the glossiness equal to that of a conventional image obtained through the lamination processing can be obtained. In addition, as compared with the conventional case, the energy is not wastefully consumed and the high speed operation is possible. Also, the essential properties of a recording material can be prevented from the trouble such as an increase in thickness or impossibility of writing, and moreover, curl is prevented from being caused in a recording material.

Furthermore, according to the present invention, there are offered the excellent effects that the apparatus can be miniaturized, a stable image can be obtained even in the case where paper sheets are continuously fed, the degree of freedom for selection of recording materials is high, the allowable temperature range of the heating body is wide, the heating color mixture process and the cooling process are set close to each other to allow only a part of an image surface to be made highly glossy, and so forth. Consequently, it is possible to provide the fixing device, the fixing method, and the image forming apparatus which are highly practical and fulfill the expected objects as well.

What is claimed is:

1. A fixing device for applying at least heat and a pressure to a recording material on which toner is carried in a shape of an image pattern to form an unfixed toner image to fix the unfixed toner image on the recording material to thereby obtain a toner image, the fixing device comprising:

a heating and temporarily fixing unit that applies at least heat to the unfixed toner image formed on the recording material to soften or melt the toner of the unfixed toner image into a state of being able to be deformed by an external force; and an image gloss control unit composed of at least one pair of rotating bodies adapted to be rotated while being in press-contact with each other to form a pressing nip portion, and serving to insert the recording material in which the toner of the unfixed toner image is maintained in the state of being able to be deformed by an external force into the pressing nip portion to thereby press and flow the toner, such that, while the toner is maintained in the state of being able to be deformed by the external force by the heating and temporarily fixing unit, the image gloss control unit pressing the toner in a nonheating manner to flow the toner, the image gloss control unit including a cooling unit that maintains surface temperatures of the at least one pair of rotating bodies at a predetermined temperature or lower.

2. A fixing device according to claim 1, wherein at least one of the at least one pair of rotating bodies is constituted of at least a base layer and a releasing layer.

3. A fixing device according to claim 2, wherein an elastic body layer is further formed between the base layer and the releasing layer.

4. A fixing device according to claim 1, wherein the press-contact of the at least one pair of rotating bodies is made releasable.

5. A fixing device according to claim 1, wherein a press-contact force of the at least one pair of rotating bodies is made variable.

6. A fixing device according to claim 1, wherein a surface temperature of the toner after executing a treatment therefor by the image gloss control unit is adjusted so as to become lower than a temperature at which the toner becomes the state of being able to be deformed by the external force.

7. A fixing device according to claim 1, wherein the heating and temporarily fixing unit is a unit including a heating rotating body and a pressing rotating body adapted to be rotated while being in press-contact with each other to form a fixing nip portion, and is for inserting the recording material on which the unfixed toner image formed into the fixing nip portion to soften or melt the toner of the unfixed toner image into the state of being able to be deformed by the external force.

8. A fixing device according to claim 5, wherein a pressure applied to the recording material in the image gloss control unit is higher than that in the heating and temporarily fixing unit.

9. A fixing device according to claim 1, further comprising a fixing condition control mechanism for controlling at least one of a heating time and a heating temperature in the heating and temporarily fixing unit in accordance with a kind of the recording material to be used.

10. An image forming apparatus comprising at least: an unfixed toner image forming unit that makes a surface of a recording material carry toner in a shape of an image pattern to form an unfixed toner image; and a fixing unit that heats and presses the unfixed toner image carried on the surface of the recording material to fix the toner image, wherein the fixing unit is comprised of the fixing device as claimed in claim 1.

11. An image forming apparatus according to claim 10, wherein the unfixed toner image forming unit is a unit that forms an unfixed toner image in accordance with an electrophotographic system.

12. A fixing device for applying at least heat and a pressure to a recording material on which toner is carried in a shape of an image pattern to form an unfixed toner image to fix the unfixed toner image on the recording material to thereby obtain a toner image, the fixing device comprising;

a heating and temporarily fixing unit that applies at least heat to the unfixed toner image formed on the recording material to soften or melt the toner of the unfixed toner image into a state of being able to be deformed by an external force;

an image gloss control unit composed of at least one pair of rotating bodies adapted to be rotated while being in press-contact with each other to form a pressing nip portion, and serving to insert the recording material in which the toner of the unfixed toner image is maintained in the state of being able to be deformed by an external force into the pressing nip portion to thereby press and flow the toner, such that, while the toner is maintained in the state of being able to be deformed by the external force by the heating and temporarily fixing unit, the image gloss control unit pressing the toner in a nonheating manner to flow the toner; and wherein at least one of the at least one pair of rotating bodies is constituted of at least a base layer and a releasing layer, and an elastic body layer is further formed between the base layer and the releasing layer, and a surface hardness control layer is provided between the elastic body and the releasing layer.

13. A fixing device according to claim 12, wherein an elastic modulus of a material that forms the surface hardness control layer is higher than an elastic modulus of each of materials that forms the elastic layer and the releasing layer, respectively.

14. A fixing device for applying at least heat and a pressure to a recording material on which toner is carried in a shape of an image pattern to form an unfixed toner image to fix the unfixed toner image on the recording material to thereby obtain a toner image, the fixing device comprising:

a heating and temporarily fixing unit that applies at least heat to the unfixed toner image formed on the recording material to soften or melt the toner of the unfixed toner image into a state of being able to be deformed by an external force; and an image gloss control unit that, while the toner is maintained in the state of being able to be deformed by the external force by the heating and temporarily fixing unit, presses the toner in a nonheating manner to flow the toner, wherein a heat insulating structure against the outside air is adopted between the heating and temporarily fixing unit and the image gloss control unit.

15. A fixing device for applying at least heat and a pressure to a recording material on which toner is carried in a shape of an image pattern to form an unfixed toner image to fix the unfixed toner image on the recording material to thereby obtain a toner image, the fixing device comprising:

a heating and temporarily fixing unit that applies at least heat to the unfixed toner image formed on the recording material to soften or melt the toner of the unfixed toner image into a state of being able to be deformed by an external force;

an image gloss control unit that, while the toner is maintained in the state of being able to be deformed by the external force by the heating and temporarily fixing unit, presses the toner in a nonheating manner to flow the toner; and a heat holding device that holds heat between the heating and temporarily fixing unit and the image gloss control unit.

16. A fixing method of applying at least heat and a pressure to a recording material on which toner is carried in a shape of an image pattern to form an unfixed toner image to fix the unfixed toner image on the recording material to thereby obtain a toner image, the fixing method comprising:

a heating and temporarily fixing process for applying at least heat to the unfixed toner image formed on the recording material to soften or melt the toner of the unfixed toner image into a state of being able to be deformed by an external force; and an image gloss control process for, while the toner is maintained in the state of being able to be deformed by an external force through the heating and temporarily fixing process, pressing the toner in a nonheating manner to flow the toner, wherein the image gloss control process is a process for inserting the recording material on which the unfixed toner image is formed with the toner maintained in a state of being able to be deformed by the external force into a pressing nip portion to press and flow the toner, the pressing nip portion being formed by of at least one pair of rotating bodies adapted to be rotated while being in press-contact with each other, and surface temperatures of the at least one pair of rotating bodies are maintained by a cooling unit to be a predetermined temperature or lower.

17. A fixing method according to claim 16, wherein a press-contact force of the at least one pair of rotating bodies is made variable in accordance with a degree of desired image glossiness.

18. A fixing method according to claim 16, wherein a surface temperature of the toner after executing the processing therefor in the image gloss control process is adjusted to become lower than the temperature at which the toner can be deformed by an external force.

19. A fixing method according to claim 16, wherein the heating and temporarily fixing process is a process for inserting the recording material on which the unfixed toner image is formed into a fixing nip portion to soften or melt the toner of the unfixed toner image into the state of being able to be deformed by the external force, the fixing nip portion being formed by a heating rotating body and a pressing rotating body adapted to be rotated while being in press-contact with each other.

20. A fixing method according to claim 19, wherein a pressure applied to the recording material in the image gloss control process is larger than that in the heating and temporarily fixing process.

21. A fixing method according to claim 16, wherein at least one of a heating time and a heating temperature in the heating and temporarily fixing process is controlled in accordance with a kind of applied recording material.

22. A fixing method according to claim 16, wherein for processes from the heating and temporarily fixing process to the image gloss control process, the heat of the recording material on which the unfixed toner image is formed with the toner in a softening or melting state is held.

* * * * *